US011328704B2

(12) United States Patent
Wang et al.

(10) Patent No.: US 11,328,704 B2
(45) Date of Patent: May 10, 2022

(54) ACTIVE VIBRATORY NOISE REDUCTION SYSTEM

(71) Applicant: HONDA MOTOR CO., LTD., Tokyo (JP)

(72) Inventors: Xun Wang, Saitama (JP); Toshio Inoue, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/211,300

(22) Filed: Mar. 24, 2021

(65) Prior Publication Data

US 2021/0304726 A1 Sep. 30, 2021

(30) Foreign Application Priority Data

Mar. 31, 2020 (JP) ..... JP2020-062499
Mar. 17, 2021 (JP) ..... JP2021-043339

(51) Int. Cl.
*G10K 11/178* (2006.01)

(52) U.S. Cl.
CPC .. *G10K 11/17854* (2018.01); *G10K 11/17883* (2018.01); *G10K 2210/1282* (2013.01); *G10K 2210/3023* (2013.01); *G10K 2210/3026* (2013.01); *G10K 2210/3027* (2013.01); *G10K 2210/3028* (2013.01)

(58) Field of Classification Search
CPC ..... G10K 11/1781; G10K 11/17813; G10K 11/17817; G10K 11/17825; G10K 11/17854; G10K 11/17883; G10K 2210/30232; G10K 2210/3033; G10K 2210/511; G10K 2210/1282; G10K 2210/128
See application file for complete search history.

(56) References Cited

U.S. PATENT DOCUMENTS

2004/0247137 A1 12/2004 Inoue et al.
2015/0269924 A1* 9/2015 Yano ..... G10K 11/17883 381/71.1

FOREIGN PATENT DOCUMENTS

JP 2000099037 A 4/2000
JP 2004361721 A 12/2004
JP 2008216375 A 9/2008

* cited by examiner

*Primary Examiner* — Kile O Blair
(74) *Attorney, Agent, or Firm* — Armstrong Teasdale LLP

(57) ABSTRACT

An active vibratory noise reduction system includes: a first estimation signal generation section configured to generate a vibratory noise estimation signal by processing standard cosine and sine wave signals with correction filters corresponding to signal transfer characteristics from a vibratory noise source to an error signal detector; a second estimation signal generation section configured to generate a canceling vibratory noise estimation signal from the standard cosine and sine wave signals by using first and second adaptive notch control filters; a virtual error signal generation section configured to generate a virtual error signal from the vibratory noise estimation signal and the canceling vibratory noise estimation signal; and a filter coefficient updating section configured to sequentially update filter coefficients of the first and second adaptive notch control filters based on first and second reference signals and the virtual error signal such that the first virtual error signal is minimized.

7 Claims, 18 Drawing Sheets

ACTIVE VIBRATORY NOISE REDUCTION SYSTEM

TECHNICAL FIELD

The present disclosure relates to an active vibratory noise reduction system for generating control sound that is in opposite phase with the vibratory noise, such as in-compartment noise, generated from engine rotation, vehicle travel, etc. and making the control sound interfere with the vibratory noise to reduce the vibratory noise.

BACKGROUND ART

As a method for reducing the noise in a passenger compartment, there is a control method using an algorithm called a direct adaptive algorithm, which does not require pre-identification of acoustic characteristics C and can follow the change in the acoustic characteristics C during control.

JP2008-216375A discloses a noise canceling system (active silencer) that uses the direct adaptive algorithm (see FIG. 1 of JP2008-216375A). The noise canceling system disclosed in JP2008-216375A includes three finite impulse response (FIR) filters serving as an adaptive filter for noise reduction (control FIR filter (C)), an adaptive filter representing estimated characteristics of a noise transfer path (W1) from a noise source to an error microphone (control FIR filter (D)), and an adaptive filter representing estimated characteristics of a transfer path (G) from a control loudspeaker to the error microphone (control FIR filter (K)). Adaptive update of the control FIR filters uses two virtual error signals e1, e2 generated in the system from an error signal e detected by the error microphone.

The noise canceling system that uses the direct adaptive algorithm shown in FIG. 1 of JP2008-216375A operates in accordance with the following principle.

$$e1=e-r*C*K-r*D,\ e2=r*D+r*K*C$$

Here, e1 is a virtual error signal, e2 is a virtual error signal, e is an error signal, r is a time series signal vector of the reference signal, * is filtering calculation (convolution calculation in the FIR filter), C is a filter coefficient of the control FIR filter (C), K is a filter coefficient of the control FIR filter (K), and D is a filter coefficient of the control FIR filter (D).

Thus, in the direct adaptive algorithm, two virtual error signals e1, e2 are calculated in the system. By adding the two virtual error signals e1, e2 in the above formulas, the below formula is obtained.

$$e1+e2=e-r*C*K+r*K*C$$

If the two virtual error signals e1, e2 simultaneously converge to the minimum value (0), the control FIR filter (C) and the control FIR filter (K), which are updated using the virtual error signals e1, e2, also converge to constant values, so that e becomes 0 in the above formula.

From the foregoing, it is understood that if, during the control, the virtual error signals e1, e2 simultaneously converge to the minimum value without using the pre-measured values of the acoustic characteristics (G), the sound pressure (e) at the error microphone position also converge to the minimum value.

In the following, description will be made of "the direct adaptive algorithm using FIR filters" and "filter coefficient update by a least mean square (LMS) algorithm."

First, with reference to FIG. 1, the direct adaptive algorithm using FIR filters will be described. As shown in FIG. 1, in this active vibratory noise reduction system, primary path transfer characteristics d^ representing the transfer characteristics of a primary path and secondary path transfer characteristics y^ representing the transfer characteristics of a secondary path are used. The primary path is a path from the vibratory noise source to the error signal detector (error microphone). The secondary path is a path from the vibratory noise canceler (secondary sound source, loudspeaker) to the error signal detector.

From the block diagram of the direct adaptive algorithm shown in FIG. 1, the principle that the noise can be canceled without need for pre-identification of C and even if C changes during the control is expressed as follows.

$$e_n=d_n+y_n=H_n*x_n+C_n*W_n*x_n \quad (a)$$

$$e1_n=e_n-\hat{y}_n-\hat{d}_n=e_n-\hat{C}_n*W_n*x_n-\hat{H}_n*x_n \quad (b)$$

$$e2_n=\hat{d}_n+\hat{y}_n=\hat{H}_n*x_n+\hat{C}_n*W_n*x_n \quad (c)$$

Here, "^" indicates an identified value (estimated value).

When e1 and e2 converge to the minimum value (=0), the following simultaneous equations hold from the formula (b) and the formula (c).

$$e_n-\hat{C}_n*W_a*x_n-\hat{H}_n*x_n=0 \quad (1)$$

$$\hat{H}_n*x_n+\hat{C}_n*W_n*x_n=0 \quad (2)$$

From the formula (2), the below formula holds.

$$\hat{C}_n*W_n*x_n=-\hat{H}n*x_n$$

$$W_n=-\hat{H}_n/\hat{C}_n \quad (3)$$

From the formula (1) and the formula (3), the below formula holds.

$$e_n-\hat{C}_n*W_n*x_n-\hat{H}_n*x_n=H_n*x_n+C_n*W_n*x_n-\hat{C}_n*(-\hat{H}_n/\hat{C}_n)*x_n-\hat{H}_n*x_n=0$$

$$H_n*x_n+C_n*W_n*x_n=0$$

$$C_n*W_n*x_n=-H_n*x_n$$

$$W_n=-H_n/C_n \quad (5)$$

$$\therefore W_n=-H_n/C_n=-\hat{H}_n/\hat{C}_n \quad (4)$$

By substituting the formula (5) to the formula (a), the below formula is derived, and "e=0" is achieved.

$$e_n=d_n+y_n=H_n*x_n+C_n*W_n*x_n=H_n*x_n+C_n*(-H_n/C_n)*x_n=0$$

Thus, according to the direct adaptive algorithm, even when the true values of H^ and C^ are unknown, if e1 and e2 converge to "0," the ratio between H^ and C^ converges to a constant value (H^ and C^ converge to respective constant values), and the control filter coefficient W also converge to the optimal value (=−H/C), whereby the error signal e is minimized. This is the principle that the direct adaptive algorithm can achieve noise canceling (or vibration damping) without need for pre-identification of C and even if C changes during the control.

Next, the update of the filter coefficients performed according to the LMS algorithm using the virtual error signals e1 and e2 in the direct adaptive algorithm using FIR filters will be described. The update of H^ is represented by the below formula.

$$\partial e1_n^2/\partial H\hat{}_n = -2*e_n*x_n + 2*C\hat{}_n*W_n*x_n^2 + 2*H\hat{}_n*x_n^2$$
$$= -2*(e_n - C\hat{}_n*W_n*x_n - H\hat{}_n*x\hat{}_n)*x_n$$
$$= -2*e1_n*x_n$$
$$\therefore H\hat{}_{n+1} = H\hat{}_n - \mu*e1_n*x_n \quad (6)$$

The update of C^ is represented by the below formula.

$$\partial e1_n^2/\partial C\hat{}_n = -2*e_n*W_n*x_n + 2*C\hat{}_n*W_n^2*x_n^2 + 2*H\hat{}_n*W_n*x_n^2$$
$$= -2*(e_n - C\hat{}_n*W_n*x_n - H\hat{}_n*x\hat{}_n)*W_n*x_n$$
$$= -2*e1_n*x_n$$
$$\therefore C\hat{}_{n+1} = C\hat{}_n - \mu*e1_n*W_n*x_n \quad (7)$$

The update of W is represented by the below formula.

$$\partial e2_n^2/\partial W_n = 2*H\hat{}_n*C\hat{}_n*x_n^2 + 2*C\hat{}_n^2*W_n*x_n^2$$
$$= 2*(H\hat{}_n*x_n + C\hat{}_n*W_n*x_n)*C\hat{}_n*x_n$$
$$= 2*e2_n*C\hat{}_n*x_n$$
$$\therefore W_{n+1} = W_n*\mu*e2_n*C\hat{}_n*x_n \quad (8)$$

Each update formula uses the LMS algorithm to sequentially update the filter coefficient based on the input signal and the error signal such that the error signal is minimized. Here, p in each update formula is a parameter having a positive scalar quantity for controlling (determining) the amount of update of the filter coefficients of the adaptive filter for each sampling, and is called a step size parameter. Note that, in general, the step size parameter is a positive constant.

From the foregoing, e1 and e2 are expressed by the below formulas.

$$H\hat{}_n += H\hat{}_n - \mu*e1_n*x_n \quad (6)$$

$$C\hat{}_{n+1} = C\hat{}_n - \mu*e1_n*W_n*x_n \quad (7)$$

$$W_{n+1} = W_n - \mu*e2_n*C\hat{}_n*x_n \quad (8)$$

$$e1_n = e_n - y\hat{}_n - d\hat{}_n = e_n - C\hat{}_n*W_n*x_n - H\hat{}_n*x_n \quad (b)$$

$$e2_n = d\hat{}_n + y\hat{}_n = H_n*x_n + C\hat{}_n*W_n*x_n \quad (c)$$

Here, n denotes the time step, and N denotes the tap number (impulse length) of the above three FIR filters. Also, x (n) denotes a standard signal, and X (n) is defined by the following formula. Note that X (n) represents a time series signal vector of the standard signal.

$$x_n = X(n) = [x(n), x(n-1), x(n-2), \ldots, x(n-N+1)]^{\tau}$$

The filter coefficients of the primary path model (estimated value, filter), the secondary path model (estimated value, filter), and the control filter are expressed as follows.

$$H\hat{}_n = [h_0(n), h_1(n), h_2(n), \ldots, h_{N-1}(n)]^{\tau}$$

$$C\hat{}_n = [c_0(n), c_1(n), c_2(n), \ldots, C_{N-1}(n)]^{\tau}$$

$$W_n = [w_0(n), w_1(n), w_2(n), \ldots, w_{N-1}(n)]^{\tau}$$

The error signal $e_n$=e (n), which is a measured value (scalar).

Assuming that the output of the secondary sound source (loudspeaker output, control filter output) is denoted by u (n), this is represented by the following formula.

$$u(n) = \sum_{i=0}^{N-1} w_i(n)*x(n-i) = W_n \underline{*} X(n) = W_n^T * X(n),$$

where "*" indicates convolution sum.

Also, U (n) is expressed by the following formula.

$$U(n) = [u(n), u(n-1), u(n-2), \ldots, u(n-N+1)]^T$$
$$= \left[\sum_{i=0}^{N-1} w_i(n)*x(n-i), \sum_{i=0}^{N-1} w_i(n)*x(n-1-i), \sum_{i=0}^{N-1} w_i(n)*x(n-2-i), \ldots, \sum_{i=0}^{N-1} w_i(n)*x(n-N+1-i)\right]^T$$

Assuming that the reference signal is denoted by r (n), this is represented by the following formula.

$$r(n) = \sum_{i=0}^{N-1} C_i(n)*x(n-i) = C_n \underline{*} X(n) = C\hat{}_n^T * X(n),$$

where "*" indicates convolution sum.

Here. R (n) is expressed as follows.

$$R(n) = [r(n), r(n-1), r(n-2), \ldots, r(n-N+1)]^T$$
$$= \left[\sum_{i=0}^{N-1} c_i(n)*x(n-i), \sum_{i=0}^{N-1} c_i(n)*x(n-1-i), \sum_{i=0}^{N-1} c_i(n)*x(n-2-i), \ldots, \sum_{i=0}^{N-1} c_i(n)*x(n-N+1-i)\right]^T$$

From the formula (b), the below formula is derived.

$$e1_n = e1(n) = e(n) - y(n) - d(n) \quad (9)$$
$$= e(n) - C\hat{}_n \underline{*} U(n) - H\hat{}_n \underline{*} X(n),$$
$$= e(n) - C\hat{}_n^T U(n) - H\hat{}_n^T * X(n)$$
$$= e(n) - \sum_{i=0}^{N-1} c_i(n)*u(n-i) - \sum_{i=0}^{N-1} h_i(n)*x(n-i)$$
$$= e(n) - \sum_{i=0}^{N-1} c_i(n)*\sum_{j=0}^{M-1} w_j(n)*x(n-i-j) - \sum_{i=0}^{N-1} h_i(n)*x(n-i)$$

Also, from the formula (c), the below formula is derived.

$$
\begin{aligned}
e2_n = e2(n) &= d(n) + y(n) \qquad (10)\\
&= H\hat{}_n * X(n) + C\hat{}_n * U(n),\\
&= H\hat{}_n^T * X(n) + C\hat{}_n^T * U(n)\\
&= \sum_{i=0}^{N-1} h_i(n) * x(n-i) + \sum_{i=0}^{N-1} c_i(n) * u(n-i)\\
&= \sum_{i=0}^{N-1} h_i(n) * x(n-i), + \sum_{i=0}^{N-1} c_i(n) * \\
&\quad \sum_{j=0}^{M-1} w_j(n) * x(n-i-j)
\end{aligned}
$$

From the formula (6) and the formula (9), the update of Hˆ is represented as follows.

$$
\begin{aligned}
H\hat{}_{n+1} &= H\hat{}_n - \mu_0 * e1(n) * X(n) \qquad (A)\\
[h_0(n+1), \ldots, h_{N-1}(n+1)]^T &= [h_0(n), \ldots, h_{N-1}(n)]^T - \\
&\quad H\hat{}_n - \mu_0 * e1(n) * [x(n), x(n-1), \ldots, x(n-N+1)]^T
\end{aligned}
$$

$$
\begin{pmatrix} h_0(n+1) \\ h_1(n+1) \\ \vdots \\ h_{N-1}(n+1) \end{pmatrix} = \begin{pmatrix} h_0(n) \\ h_1(n) \\ \vdots \\ h_{N-1}(n) \end{pmatrix} - \mu_0 * \left[ e(n) - \sum_{i=0}^{N-1} c_i(n) * \sum_{j=0}^{M-1} w_i(n) * x(n-i-j) - \sum_{i=0}^{N-1} h_i(n) * x(n-i) \right] * \begin{pmatrix} x(n) \\ x(n-1) \\ \vdots \\ x(n-N+1) \end{pmatrix}
$$

From the formula (7) and the formula (9), the update of Cˆ is represented as follows.

$$
\begin{aligned}
C\hat{}_{n+1} &= C\hat{}_n - \mu_c * e1(n) * W_n * x(n) \qquad (B)\\
&= C\hat{}_n - \mu_c * e1(n) * U(n)\\
[c_0(n+1), \ldots, c_{N-1}(n+1)]^T &= [c_0(n), \ldots, c_{N-1}(n)]^T - \\
&\quad \mu_c * e1(n) * [u(n), u(n-1), \ldots, u(n-N+1)]^T
\end{aligned}
$$

$$
\begin{pmatrix} c_0(n+1) \\ c_1(n+1) \\ \vdots \\ c_{N-1}(n+1) \end{pmatrix} = \begin{pmatrix} c_0(n) \\ c_1(n) \\ \vdots \\ c_{N-1}(n) \end{pmatrix} - \mu_c * \left[ e(n) - \sum_{i=0}^{N-1} c_i(n) * \sum_{j=0}^{M-1} w_j(n) * x(n-i-j) - \right.
$$

-continued $$
\left. \sum_{i=0}^{N-1} h_i(n) * x(n-i) \right] * \begin{pmatrix} \sum_{i=0}^{N-1} w_i(n) * x(n-i) \\ \sum_{i=0}^{N-1} w_i(n) * x(n-1-j) \\ \vdots \\ \sum_{i=0}^{N-1} w_i(n) * x(n-N+1-i) \end{pmatrix}
$$

From the formula (8) and the formula (10), the update of W is represented as follows.

$$
\begin{aligned}
W_{n+1} &= W_n - \mu_w * e2(n) * C\hat{}_n * x(n) \qquad (C)\\
&= W_n - \mu_w * e2(n) * R(n)\\
[w_0(n+1), \ldots, w_{N-1}(n+1)]^T &= [w_0(n), \ldots, w_{N-1}(n)]^T - \\
&\quad \mu_w * e2(n) * [r(n), r(n-1), \ldots, r(n-N+1)]^T
\end{aligned}
$$

$$
\begin{pmatrix} w_0(n+1) \\ w_1(n+1) \\ \vdots \\ w_{N-1}(n+1) \end{pmatrix} = \begin{pmatrix} w_0(n) \\ w_1(n) \\ \vdots \\ w_{N-1}(n) \end{pmatrix} - \mu_w * \left[ \sum_{i=0}^{N-1} h_i(n) * x(n-i), + \sum_{i=0}^{N-1} c_i(n) * \sum_{j=0}^{M-1} w_j(n) * x(n-i-j) \right] * \begin{pmatrix} \sum_{i=0}^{N-1} c_i(n) * x(n-i) \\ \sum_{i=0}^{N-1} c_i(n) * x(n-1-i) \\ \vdots \\ \sum_{i=0}^{N-1} c_i(n) * x(n-N+1-i) \end{pmatrix}
$$

According to the direct adaptive algorithm, pre-identification of the acoustic characteristics C of the space transfer path from the control sound source (loudspeaker) to the error microphone is not necessary, and noise canceling (or vibration damping) can be effected even if C changes during the control. However, in the direct adaptive algorithm, three adaptive filters, namely, the control filter (filter coefficient W), the filter for the primary path model (filter coefficient Hˆ), and the filter for the secondary path model (filter coefficient Cˆ) are necessary.

As shown in JP2008-216375A, in the case where an FIR filter is used in each adaptive filter, when the filter coefficients of each of the three filters are updated, convolution operation is performed as shown by the aforementioned update formulas (A), (B), and (C), which increases the computational load. Further, in a case of canceling the passenger compartment vibratory noise, for example, in order to cope with rapid acceleration of the vehicle, it is necessary to set a high sampling frequency and to increase the tap number of each FIR filter. Therefore, the computational load of the FIR filters becomes large, and this necessitates to use a digital signal processor with high computing power in the active vibratory noise reduction system, which makes the active vibratory noise reduction system undesirably expensive.

On the other hand, the vibratory noise generated in synchronous with the rotation of the output shaft of the engine (or the engine rotational speed), such as engine muffling sound, is a periodic complex tone (harmonic complex tone) with the fundamental frequency thereof being a half-order component of the engine rotational speed. The engine muffling sound is a vibration radiation sound generated due to transmission of vibratory excitation force generated by the engine rotation to the vehicle body, and therefore, demonstrates significant periodicity, synchronous with the engine rotation speed. For example, in a 4-cycle, 4-cylinder engine, due to the torque fluctuation caused by gas combustion that takes place for every half rotation of the engine output shaft, excitation vibration originating from the engine is generated, and this cases the vibratory noise in the passenger compartment. Therefore, in the case of a 4-cycle, 4-cylinder engine, the vibratory noise having a frequency twice as high as the engine rotational speed, which may be referred to as a rotation second order component of the engine output shaft, is dominant in the engine muffling sound. Therefore, it can be expected that, by performing the vibratory noise control focusing on the dominant vibratory noise, the noise canceling or vibration damping effect can be achieved efficiently. With such an insight, the Applicant has proposed technology which detects the frequency that causes generation of the vibratory noise from the vibratory noise source, and uses adaptive notch filters (Single frequency Adaptive Notch (SAN) filters) to cancel noise or damp vibrations at harmonic frequencies of the detected frequency (dominant frequencies occupying the large part of the vibratory noise), so that the control is specialized for the vibratory noise control of the periodic and narrow-band noise and the noise canceling/vibration damping effect can be achieved efficiently (see JP2000-99037A, JP2004-361721A, etc.). Note that the active vibratory noise reduction system using adaptive notch filters does not require convolution operation and can execute the control with simple four arithmetic operations, and therefore, has an advantage that the computational load is very small.

In the following, an overview of the active vibratory noise reduction system using the adaptive notch filter is described.

The adaptive notch filter shown in FIG. 2 having a filter coefficient C^ can be considered to multiply the magnitude by C and delay the phase. Assuming that the frequency is denoted by f, 1 [sec] corresponds to 2πf [rad], and time t [sec] corresponds to x [rad], the below formula is obtained.

$$1:2\pi f=t:x$$

$$\therefore x=2\pi ft$$

Provided that C^ delays the phase by φ, the below formulas are obtained.

$$C\hat{}=(C0+iC1),\ \hat{C}\cos(\varphi)=C0,\ \hat{C}\sin(\varphi)=C1$$

$$\text{when } f(t)=\cos(2nft)=xc$$

$$\begin{aligned}\therefore f'(t)&=C\hat{}*f(t)\\&=(C0+iC1)*\cos(2nft)\\&=C0*xc+iC1*xc\\&=C0*xc+C1*xs\end{aligned}$$

-continued $$\text{when } f(t)=\sin(2nft)=xs$$

$$\begin{aligned}f'(t)&=C\hat{}*f(t)\\&=(C0+iC1)*\sin(2nft)\\&=C0*xs+iC1*xs\\&=C0*xs+C1*xc\end{aligned}$$

$$\because i*\cos(2nft)=\cos(2nft-n/2)=-\sin(2nft)$$

$$i*\sin(2nft)=\sin(2nft-n/2)=\cos(2nft)$$

This is because multiplying by i means rotating by π/2 (90 degrees) counterclockwise, as shown in FIG. 3. Also, multiplying by −i means rotating by 90 degrees clockwise, and therefore, the below formulas hold.

$$i*xc=\cos(\theta+\pi/2)=-\sin(\theta)-xs$$

$$i*xs=\sin(\theta+\pi/2)=\cos(\theta)=xc$$

$$-i*xc=\cos(\theta-\pi/2)=\sin(\theta)=xs$$

$$-i*xs=\sin(\theta-\pi/2)=-\cos(\theta)=-xc$$

Therefore, the adaptive notch filter is configured as shown in FIG. 4. Note that the standard sine wave signal xs and the standard cosine wave signal xc are represented by the below formulas.

$$xc=\cos(2\pi ft)$$

$$xs=\sin(2\pi ft)$$

Next, description will be made of the LMS algorithm. Regarding the error signal e shown in FIG. 5, the below formulas hold.

$$e=d+y=n1*x+k1*m1*x$$

$$\begin{aligned}J=e^2&=(n1*x+k1*m1*x)^2\\&=n1^2x^2+2n1k1m1x^2+k1^2m1^2x^2\\&=x^2(n1^2+2n1k1m1+k1^2m1^2),\end{aligned}$$

where J is referred to as an estimation function.

The LMS algorithm obtains the filter coefficient k1 (filter coefficient of the control filter of the loudspeaker) that minimizes the estimation function J, and specifically, updates the filter coefficient k1 with a value (slope Δ) obtained by partially differentiating the estimation function J (or $e^2$) with respect to the filter coefficient k1. The slope Δ is obtained as follows.

$$\begin{aligned}\Delta&=\partial e^2/\partial k1\\&=0+2n1m1x^2+2k1m1^2x^2\\&=2m1x(n1x+k1m1x)\\&=2*m1*x*e\\&=2*e*m1*x\end{aligned}$$

With the slope Δ of the estimation function or the square error obtained, the transfer characteristics (k1) that minimizes the estimation function or the square error ($e^2$) are obtained by using the slope Δ as the step size parameter p according to the update formula for the adaptation process using the LMS algorithm, as shown by the below formula.

$$k1_{n+1}=k1_n-\mu*e_n*m1*x_n$$

Next, with reference to FIG. 6, the LMS algorithm using adaptive notch filters will be described. The following formulas are derived from cos signal (xc) and sin signal (xs) multiplied by i.

$$i*xc(n)=i*\cos(2\pi ft)=\cos(2\pi ft+\pi/2)=-\sin(2\pi ft)=-xs(n)$$

$$i*xs(n)=i*\sin(2\eta ft)=\sin(2\eta ft+\eta/2)=\cos(2\pi ft)=xc(n)$$

The canceling vibratory noise estimation y of the secondary path is represented by the below formula.

$$\begin{aligned} y &= C\hat{}*[W0*xc(n)+W1*xs(n)],\ C\hat{}=C0+iC1 \\ &= [C0+iC1]*[W0*xc(n)+W1*xs(n)] \\ &= W0*[C0*xc(n)+C1*xs(n)]+W1*[C0*xs(n)-C1*xc(n)] \end{aligned}$$

In FIG. 6, the canceling sound transfer characteristics estimated value C^ is represented by the below formula.

$$C\hat{}=C0-iC1$$

The update of W0 and W1 is performed according to the below formula.

$$\begin{aligned} e(n) &= d(n)+y(n) \\ &= \{d(n)+W0*[C0*xc(n)-C1*xs(n)]+ \\ &\quad W1*(C0*xs(n)+C1*xc(n))\} \end{aligned}$$

$$\begin{aligned} J &= \{e(n)\}^2 = \\ &\{d(n)+W0*[C0*xc(n)-C1*xs(n)]+W1*[C0*xs(n)+C1*xc(n)]\}^2 \end{aligned}$$

The LMS algorithm obtains the filter coefficients W0, W1 that minimize the estimation function J, and specifically, updates the filter coefficients W0, W1 by using, as the step size parameters, the values obtained by partially differentiating the estimation function J with respect to the filter coefficients W0, W1 of the adaptive notch filter that is a control filter for the loudspeaker. The update formulas for the filter coefficients W0, W1 are expressed as follows.

$$\begin{aligned} \partial J/\partial W0 &= 2*e(n)*\{e(n)\}' \\ &= 2*e(n)*[C0*xc(n)-C1*xs(n)] \\ \therefore W0(n+1) &= W0(n)-\mu*e*[C0*xc(n)-C1*xs(n)] \\ \partial J/\partial W1 &= 2*e(n)*\{e\} \\ &= 2*e*[C0*xs(n)-C1(n)*xc(n)] \\ \therefore W1(n+1) &= W1(n)-\mu*e*[C0*xs(n)+C1*xc(n)] \end{aligned}$$

FIG. 7 is a block diagram of the LMS algorithm using an XAT-based adaptive notch filter. In this example, the filter coefficients W0, W1 are represented by the below formulas.

$$\therefore W0_{n+1}=W0_n-\mu_{w0}*e_n*(C0*xc_n-C1*xs_n)$$

$$W1_{n+1}=W1_n-\mu_{w1}*e_n*(C0*xs_n+C1*xc_n)$$

However, since the control system using the direct adaptive algorithm described in JP2008-216375A updates three FIR filters during the control, there is a problem that the amount of calculation is large and the convergence is slow compared to the conventional control system using the Filtered-X algorithm. To address this problem, the control system of JP2008-216375A adopts a method which uses a fast FTF adaptive algorithm in the initial convergence, and after convergence, uses the LMS algorithm which is excellent in stability. However, regarding the problem of computational load, since the control system of JP2008-216375A uses FIR filters that need a large amount of calculation, it requires a processor with high computational power to implement the control method, which makes the control device expensive.

In a case where the adaptive notch filter disclosed in JP2000-99037A or JP2004-361721A is used in the direct adaptive algorithm, it is important to optimally model the primary and the secondary path characteristics. If they are not optimally modeled, optimal reference signals for updating the filter coefficient of the adaptive notch filter as the control filter cannot be obtained, and it may be difficult to sufficiently respond to rapid acceleration of the vehicle, for example, and sufficient vibratory noise control effect cannot be obtained.

SUMMARY OF THE INVENTION

In view of such background, an object of the present invention is to provide an active vibratory noise reduction system which is low in cost and in which, to perform Active Noise Control (ANC) for eliminating the noise according to the engine rotation speed or the like, adaptive notch filters (Single frequency Adaptive Notch (SAN) filters) which require a small computational load are used to constitute a control system (SAN filter direct adaptive algorithm) that does not require pre-identification of the acoustic characteristics C and is capable of following a change in C during the control, so that excellent noise canceling/vibration damping performance can be achieved even if a significant change occurs in C.

To achieve such an object, one embodiment of the present invention provides an active vibratory noise reduction system (10) comprising: a standard signal generation section (21) configured to generate, as standard signals, a standard sine wave signal (xs) and a standard cosine wave signal (xc) having a frequency in accordance with a frequency of vibratory noise generated from a vibratory noise source; a first adaptive notch control filter (W0) configured to output a first control signal (uc) based on the standard cosine wave signal; a second adaptive notch control filter (W1) configured to output a second control signal (us) based on the standard sine wave signal; a vibratory noise canceler (12) configured to output canceling vibratory noise (y) based on a first addition signal (u0) obtained by adding the first control signal and the second control signal; an error signal detector (11) configured to output an error signal (e) based on a difference between the vibratory noise (d) generated from the vibratory noise source and the canceling vibratory noise output from the vibratory noise canceler; and a correction section (27) configured to generate first and second reference signals (r0, r1) by correcting the standard cosine wave signal and the standard sine wave signal with a first correction filter (C^0) and a second correction filter (C^1) corresponding to signal transfer characteristics (C) from the vibratory noise canceler to the error signal detector for the frequency of the standard signals.

The active vibratory noise reduction system further comprises: a first estimation signal generation section (28) configured to correct the standard cosine wave signal and the standard sine wave signal with a third correction filter (H^0)

and a fourth correction filter (H^1) to obtain first and second vibratory noise estimation signals, respectively, and to generate a vibratory noise estimation signal (d^) by adding the first vibratory noise estimation signal and the second vibratory noise estimation signal; a second estimation signal generation section (27, 70) configured to generate a first canceling vibratory noise estimation signal (y^2) by adding a first corrected control signal obtained by correcting the standard cosine wave signal with the first correction filter (C^0) and the first adaptive notch control filter (W0), a second corrected control signal obtained by correcting the standard sine wave signal with the second correction filter (C^1) and the first adaptive notch control filter (W0), a third corrected control signal obtained by correcting the standard sine wave signal with the first correction filter (C^0) and the second adaptive notch control filter (W1), and a fourth corrected control signal obtained by correcting the standard cosine wave signal with the second correction filter (C^1) and the second adaptive notch control filter (W1); a first virtual error signal generation section (82) configured to generate a first virtual error signal (e'2) from the vibratory noise estimation signal (d^) and the first canceling vibratory noise estimation signal (y^2); and a first filter coefficient updating section (72, 74) configured to sequentially update filter coefficients of the first and second adaptive notch control filters (W0, W1) based on the first and second reference signals (r0, r1) and the first virtual error signal (e'2) such that the first virtual error signal is minimized.

In the above configuration, preferably, the first adaptive notch control filter (W0) is configured to output a third control signal based on the standard sine wave signal, the second adaptive notch control filter (W1) is configured to output a fourth control signal based on the standard cosine wave signal, the first correction filter (C^0) is configured by a first adaptive notch correction filter, and the second correction filter (C^1) is configured by a second adaptive notch correction filter, the active vibratory noise reduction system further comprising: a third estimation signal generation section (60) configured to generate a second canceling vibratory noise estimation signal (y^1) by adding a fifth corrected control signal, which is obtained by correcting the first addition signal (u0) with the first adaptive notch correction filter (C^0), and a sixth corrected control signal, which is obtained by correcting, with the second adaptive notch correction filter (C^1), a second addition signal (u1) obtained by adding the third control signal and the fourth control signal; a second virtual error signal generation section (81) configured to generate a second virtual error signal (e'1) from the error signal (e), the vibratory noise estimation signal (d^), and the second canceling vibratory noise estimation signal (y^1); and a second filter coefficient updating section (62, 64) configured to sequentially update filter coefficients of the first and second adaptive notch correction filters (C^0, C^1) based on the first control signal, the second control signal, the third control signal, the fourth control signal, and the second virtual error signal such that the second virtual error signal is minimized.

In the above configuration, preferably, the third correction filter (H^0) is configured by a third adaptive notch correction filter, and the fourth correction filter (H^1) is configured by a fourth adaptive notch correction filter, the active vibratory noise reduction system further comprising a third filter coefficient updating section (52, 54) configured to sequentially update filter coefficients of the third and fourth adaptive notch correction filters (51, 53) based on the standard sine wave signal (xs), the standard cosine wave signal (xc), and the second virtual error signal such that the second virtual error signal is minimized.

In the above configuration, preferably, the active vibratory noise reduction system further comprises a normalization section (90) configured to calculate first and second normalized filter coefficients by multiplying the filter coefficients of the first and second adaptive notch correction filters (C^0, C^1) by a multiplicative inverse of a square root of sum of squares of the filter coefficients of the first and second adaptive notch correction filters (C^0, C^1), respectively, wherein the correction section (27) is configured to generate the first and second reference signals (r0, r1) by correcting the standard cosine wave signal (xc) and the standard sine wave signal (xs) with the first adaptive notch correction filter (C^0) having the first normalized filter coefficient and the second adaptive notch correction filter (C^1) having the second normalized filter coefficient.

In the above configuration, preferably, the active vibratory noise reduction system further comprises a normalization section (90) configured to calculate third and fourth normalized filter coefficients by multiplying the filter coefficients of the first and second adaptive notch correction filters (C^0, C^1) by a multiplicative inverse of a larger one of absolute values of the filter coefficients of the first and second adaptive notch correction filters, respectively, wherein the correction section (27) is configured to generate the first and second reference signals (r0, r1) by correcting the standard cosine wave signal and the standard sine wave signal with the first adaptive notch correction filter (C^0) having the third normalized filter coefficient and the second adaptive notch correction filter (C^1) having the fourth normalized filter coefficient.

In the above configuration, preferably, each of the first, second, and third filter coefficient updating sections (72, 74; 62, 64: 52, 54) is configured to determine a step size parameter (μ) for controlling an amount of update of the filter coefficients of the adaptive notch filters to be updated thereby based on a square root of sum of squares of the filter coefficients immediately before the update.

In the above configuration, preferably, each of the first, second, and third filter coefficient updating sections (72, 74; 62, 64; 52, 54) is configured to determine a step size parameter (μ) for controlling an amount of update of the filter coefficients of the adaptive notch filters to be updated thereby based on a larger one of absolute values of the filter coefficients immediately before the update.

Thus, according to the present invention, in a case where the error microphone is placed on the headrest near the ears of the vehicle occupant and a significant change occurs in C due to adjustment of the seat position or seat angle or due to aging, for example, it is possible to execute active vibratory noise control without deterioration of the noise canceling performance, thereby to improve the noise canceling effect near the ears of the vehicle occupant considerably.

DESCRIPTION OF THE PREFERRED EMBODIMENT(S)

In the following, embodiments of the present invention will be described in detail with reference to the drawings.

Optimal modeling when using the adaptive notch filters in the direct adaptive algorithm is performed as follows.

Assuming that the time step is denoted by n (time; t), and the standard signal at that time is denoted by x (n), x (n) is represented by the following formula. Note that in the SAN filter, orthogonal two standard signals x (xc, xs) are used.

$$xc(n)=\cos(2\eta ft)$$

$$xs(n)=\sin(2\eta ft),$$

where f is a frequency.

The filter coefficients of the primary path model (estimated value, filter), the secondary path model (estimated value, filter), and the control filter are represented as follows.

$$\hat{H}_n=\hat{H}(n)=\hat{H0}(n)+i\hat{H1}(n)$$

$$\hat{C}_n=\hat{C}(n)=\hat{C0}(n)+i\hat{C1}(n)$$

An adaptive filter for xc is denoted by W0 (*n*), and an adaptive filter for xs is denoted by W1 (*n*).

The error signal $e_n$ is denoted by e (n), which is a measured value (scalar).

Figure 8:
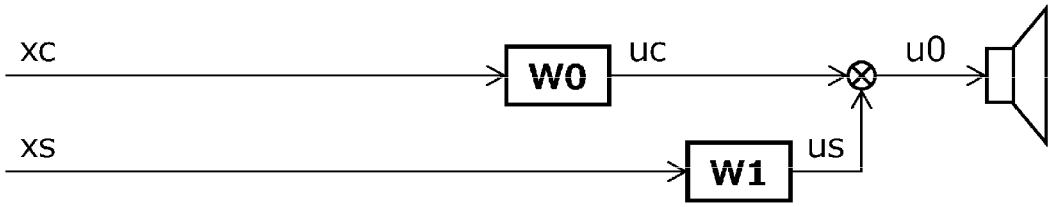
FIG. 8 is an explanatory diagram of the direct adaptive algorithm using adaptive notch filters.

As shown in FIG. 8, assuming that the secondary sound source output (loudspeaker output, control filter output) is denoted by u0 (*n*), this is represented by the following formula.

$$u0(n)=W0(n)*xc(n)+W1(n)*xs(n)$$

Assuming that the standard signal in the primary path is denoted by X, the vibratory noise estimation signal d^ (n) is represented by the following formula. Here, since the vibratory noise is generated at the vibratory noise source, it is assumed that the standard signal of the vibratory noise is a cos signal (xc).

$$\begin{aligned} d\hat{}(n) &= H\hat{}(n)*X(n) = H\hat{}(n)*xc(n) \quad i*xc(n)=-xs(n) \\ &= [H0(n)+iH1(n)]*xc(n) \qquad i*xs(n)=xc(n) \\ &= H0(n)*xc(n)+iH1(n)*xc(n) \\ &= H0(n)*xc(n)-H1(n)*xs(n) \end{aligned}$$

Note that the noise reaching (or input to) the microphone, which is denoted by d (n), is represented by the following formula.

$$\begin{aligned} d\hat{}(n) &= H\hat{}(n)*X(n) = H\hat{}(n)*xc(n) \\ &= [H0(n)+iH1(n)]*xc(n) \\ &= H0(n)*xc(n)+iH1(n)*xc(n) \\ &= H0(n)*xc(n)-H1(n)*xs(n) \end{aligned}$$

$$\because d\hat{}=d$$

The canceling vibratory noise estimation signal y^ (n) and the reference signals r0 (*n*), r1 (*n*) are represented by the following formulas.

$$\begin{aligned} y\hat{}(n) &= C\hat{}(n)*u0(n) \\ &= [C0(n)+iC1(n)]*[W0(n)*xc(n)+W1(n)*xs(n)] \\ &= \{C0*[W0(n)*xc(n)+W1(n)*xs(n)]+ \\ &\quad C1(n)*[W0(n)*xs(n)-W1(n))xc(n)]\} \end{aligned}$$

OR $$\begin{aligned} &= \{W0(n)*[C0(n)*xc(n)+C1(n)*xs(n)]+ \\ &\quad W1(n)*[C0(n)*xs(n)-C1(n)*xc(n)]\} \end{aligned}$$

$$\therefore r0(n)=C0(n)*xc(n)+C1(n)*xs(n)$$

$$r1(n)=C0(n)*xs(n)-C1(n)*xc(n)$$

The virtual error signals e1 (*n*), e2 (*n*) are represented by the following formulas.

$$\begin{aligned} e1(n) &= e(n)\cdot y\hat{}(n) - d\hat{}(n) \\ &= e(n)\cdot[C0(n)+iC1(n)]*[W0(n)*xc(n)+W1(n)*xs(n)] - \\ &\quad [H0(n)*xc+H1(n)*xs(n)] \\ &= e(n) - C0(n)*[W0(n)*xc(n)+W1(n)*xs(n)] - \\ &\quad C1(n)*[W0(n)*xs(n)-W1(n)*xc(n)] - \\ &\quad [H0(n)*xc(n)+H1(n)*xs(n)] \end{aligned}$$

$$\begin{aligned} e2(n) &= d\hat{}(n) + y\hat{}(n) \\ &= [H0(n)*xc+H1(n)*xs(n)] + \\ &\quad [C0(n)+iC1(n)]*[W0(n)*xc(n)+W1(n)*xs(n)] \\ &= [H0(n)*xc+H1(n)*xs(n)] + W0(n)* \\ &\quad [C0(n)*xc(n)+C1(n)*xs(n)] + \\ &\quad W1(n)*[C0(n)*xs(n)-C1(n)*xc(n)] \end{aligned}$$

Now, description will be made of the update of the filter coefficients according to the LMS algorithm using the virtual error signals e1 and e2 in the direct adaptive algorithm using SAN filters, with reference to the direct adaptive algorithm using FIR filters.

The update of Hˆ, namely, the update of H0 and H1 is performed in accordance with the below formula.

$$J1=\{e1(n)\}^2=\{e(n)-C0(n)*[W0(n)*xc(n)+W1(n)*xs(n)]-C1(n)*[-W0(n)*xs(n)+W1(n)*xc(n)]-[H0(n)*xc(n)-H1(n)*xs(n)]\}^2 \tag{11}$$

The LMS algorithm obtains the filter coefficients H0, H1 (filter coefficients of the adaptive notch filter representing the transfer characteristics from the vibratory noise source to the microphone (primary path)) that minimize the estimation function J1, and specifically, updates the filter coefficients H0, H1 by using, as the step size parameters, the values obtained by partially differentiating the estimation function J1 with respect to H0, H1, respectively, as shown by the below formulas.

$$\partial J1/\partial H0=\partial\{e1(n)\}^2/\partial H0=2*e1(n)*\{e1(n)\}'=-2*e1(n)*xc(n)$$

$$\therefore H0(n+1)=H0(n)-\mu_{h0}*e1(n)*xc(n)$$

$$\partial J1/\partial H1=\partial\{e1(n)\}^2/\partial H1=2*e1(n)*\{e1(n)\}'=-2*e1(n)*xs(n)$$

$$\therefore H1(n+1)=H1(n)-\mu_{h1}*e1(n)*xs(n)$$

Here, μh0 and μh1 are step size parameters. Differentiation rule regarding power is as follows.

$$(\{f(x)\}^n)'=n\{f(x)\}^{n-1}f'(x)$$

Now, description will be made of the update of the filter coefficients according to the LMS algorithm using the virtual error signals e1 and e2 in the direct adaptive algorithm using SAN filters, with reference to the direct adaptive algorithm using FIR filters. The update of Cˆ, namely, the update of C0 and C1 is performed in accordance with the above formula (11). The LMS algorithm obtains the filter coefficients C0, C1 (filter coefficients of the adaptive notch filter representing the transfer characteristics from the loudspeaker to the microphone (secondary path)) that minimize the estimation function J1, and specifically, updates the filter coefficients C0, C1 by using, as the step size parameters, the values obtained by partially differentiating the estimation function J1 with respect to C0, C1, respectively, as shown by the below formulas.

$$\partial J1/\partial C0=\partial\{e1(n)\}^2/\partial C0=2*e1(n)*\{e1(n)\}'=-2*e1(n)*[W0(n)*xc(n)+W1(n)*xs(n)]$$

$$\therefore C0(n+1)=C0(n)-\mu_{c0}*e1(n)*[W0(n)*xc(n)+W1(n)*xs(n)]$$

$$\partial J1/\partial C1=\partial\{e1(n)\}^2/\partial C1=2*e1(n)*\{e1(n)\}'=-2*e1(n)*[-W0(n)*xs(n)+W1(n)*xc(n)]$$

$$\therefore C1(n+1)=C1(n)-\mu_{c1}*e1(n)*[-W0(n)*xs(n)+W1(n)*xc(n)]$$

Here, μc0 and μc1 are step size parameters.

The update of W0 and W1 is performed in accordance with the below formula.

$$J2=\{e2(n)\}^2=\{[H0(n)*xc-H1(n)*xs(n)]+W0(n)*[C0(n)*xc(n)-C1(n)*xs(n)]+W1(n)*[C0(n)*xs(n)+C1(n)*xc(n)]\}^2$$

The LMS algorithm obtains the filter coefficients W0, W1 (filter coefficients of the adaptive notch filter constituting the control filter) that minimize the estimation function J2, and specifically, updates the filter coefficients W0, W1 by using, as the step size parameters, the values obtained by partially differentiating the estimation function J2 with respect to W0, W1, respectively, as shown by the below formulas.

$$\partial J2/\partial W0=\partial\{e2(n)\}^2/\partial W0=2*e2(n)*\{e2(n)\}'=2*e2(n)*[C0(n)*xc(n)-C1(n)*xs(n)]$$

$$\therefore W0(n+1)=W0(n)-\mu_{w0}*e2(n)*[C0(n)*xc(n)-C1(n)*xs(n)]$$

$$\partial J2/\partial W1=\partial\{e2(n)\}^2/\partial W1=2*e2(n)*\{e2(n)\}'=2*e2(n)*[C0(n)*xs(n)+C1(n)*xc(n)]$$

$$\therefore W1(n+1)=W1(n)-\mu_{w1}*e2(n)*[C0(n)*xs(n)+C1(n)*xc(n)]$$

Here, μw0 and μw1 are step size parameters.

Figure 1:
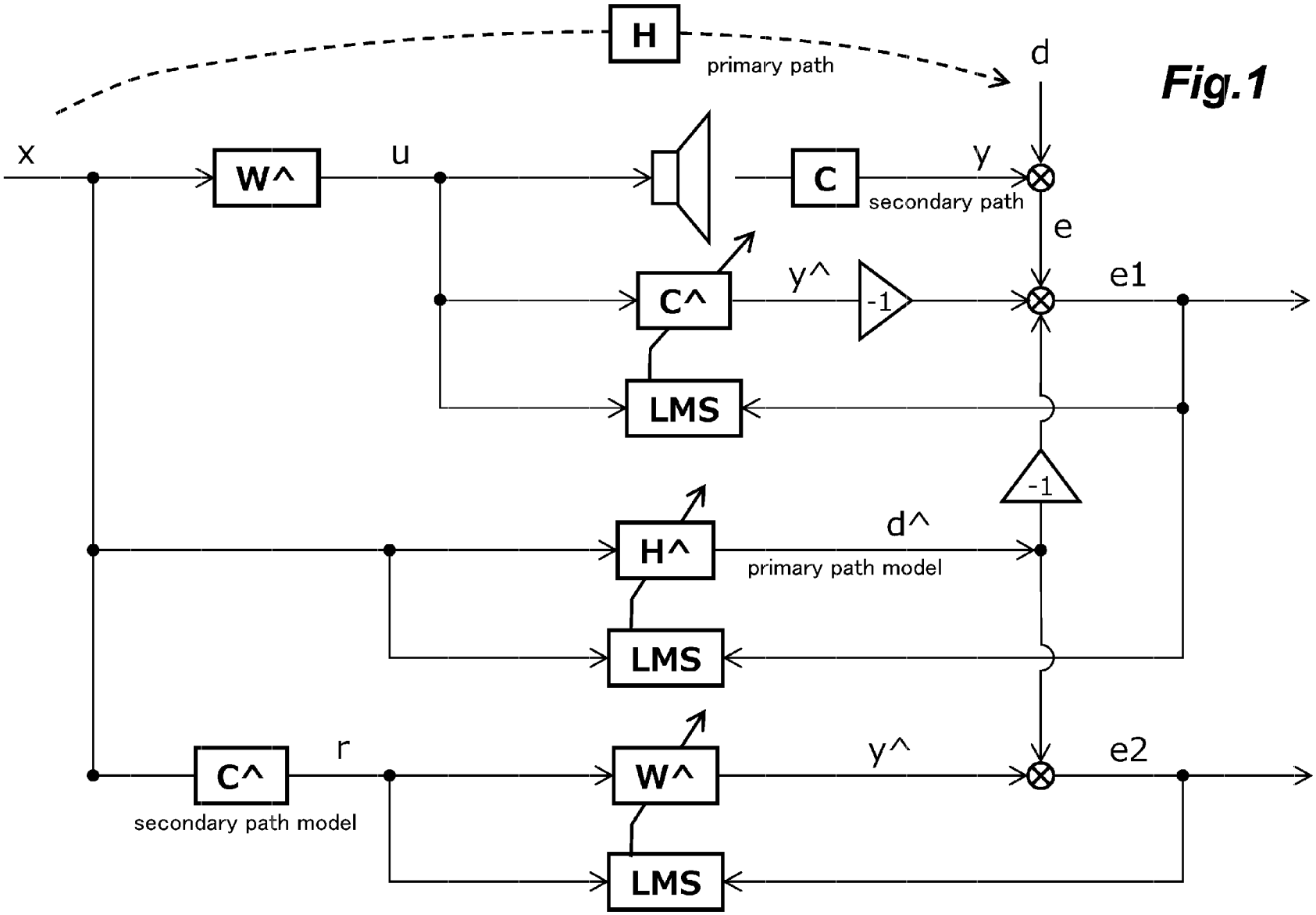
FIG. 1 is a block diagram of a vibratory noise reduction system using FIR filters according to the direct adaptive algorithm.
Figure 2:
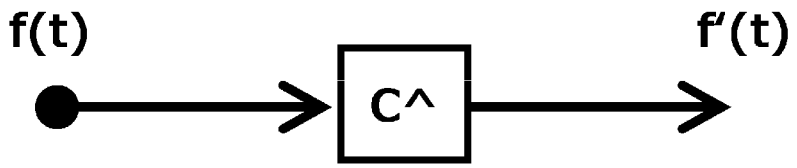
FIG. 2 is a configuration diagram of an adaptive notch filter.
Figure 3:
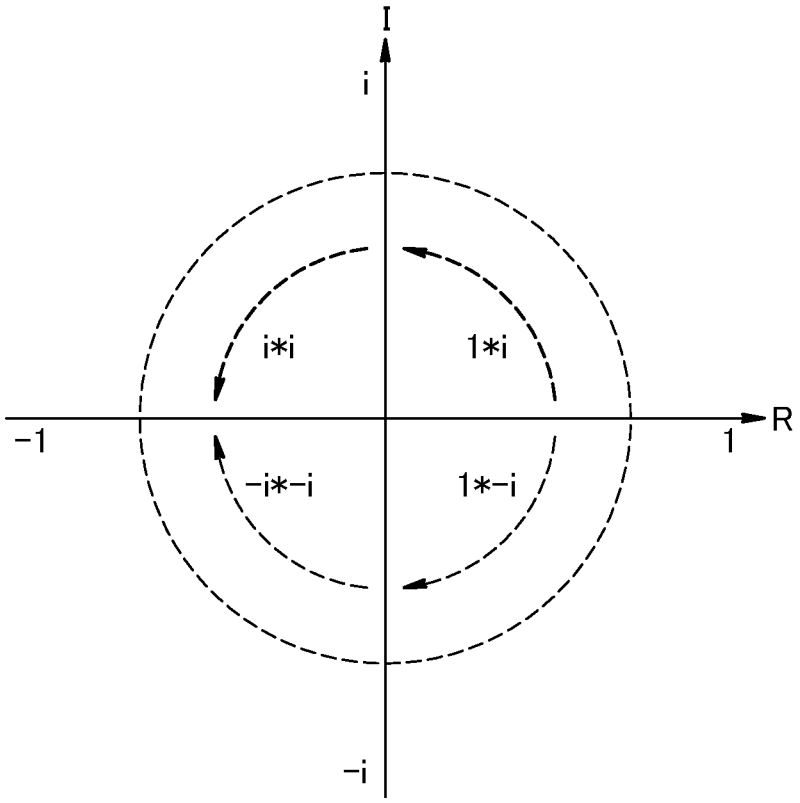
FIG. 3 is an explanatory diagram for explaining the principle of the adaptive notch filter.
Figure 4:
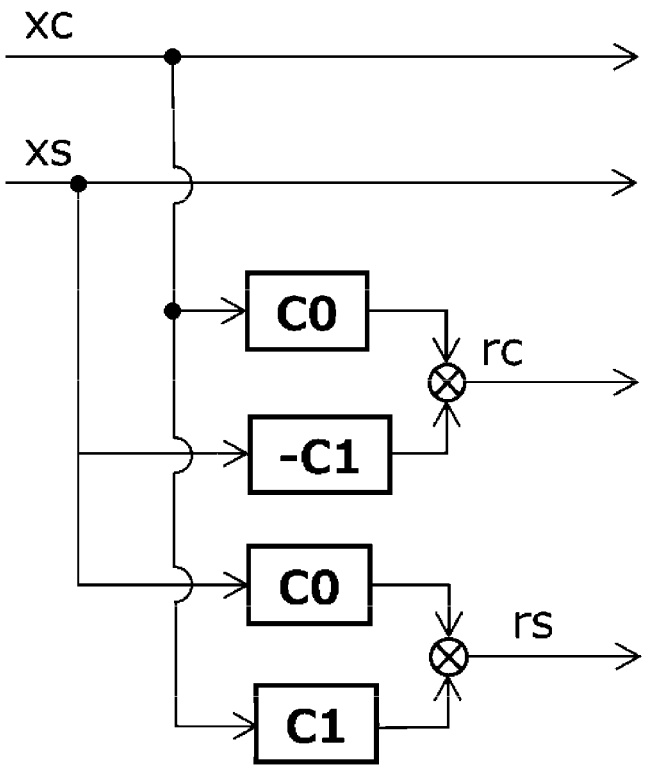
FIG. 4 is a detailed configuration diagram of the adaptive notch filter.
Figure 5:
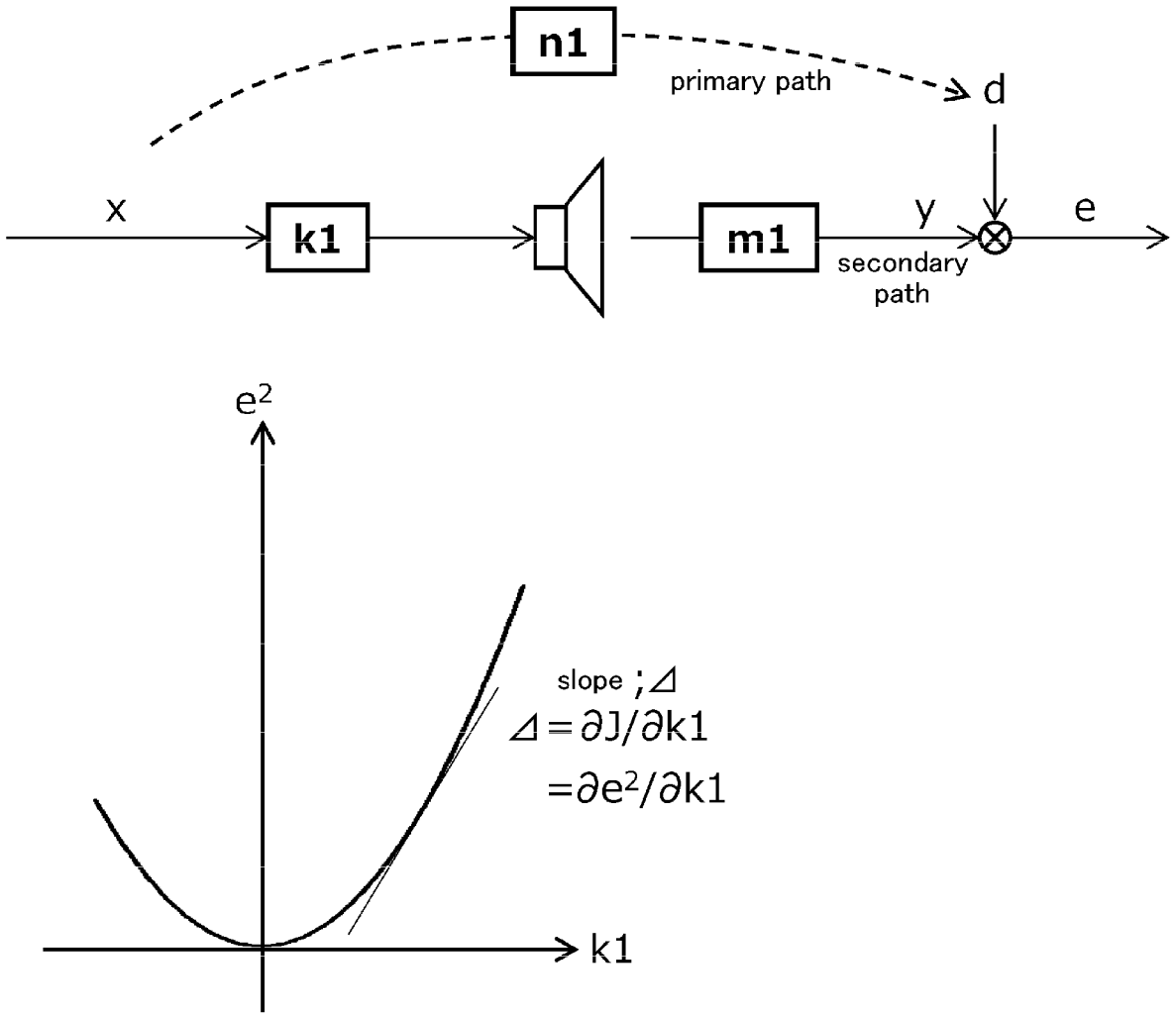
FIG. 5 is an explanatory diagram for explaining the LMS algorithm.
Figure 6:
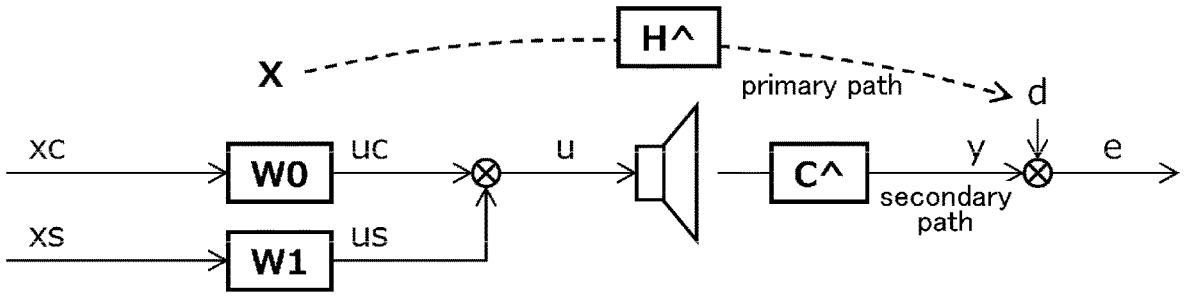
FIG. 6 is an explanatory diagram for explaining the LMS algorithm.
Figure 7:
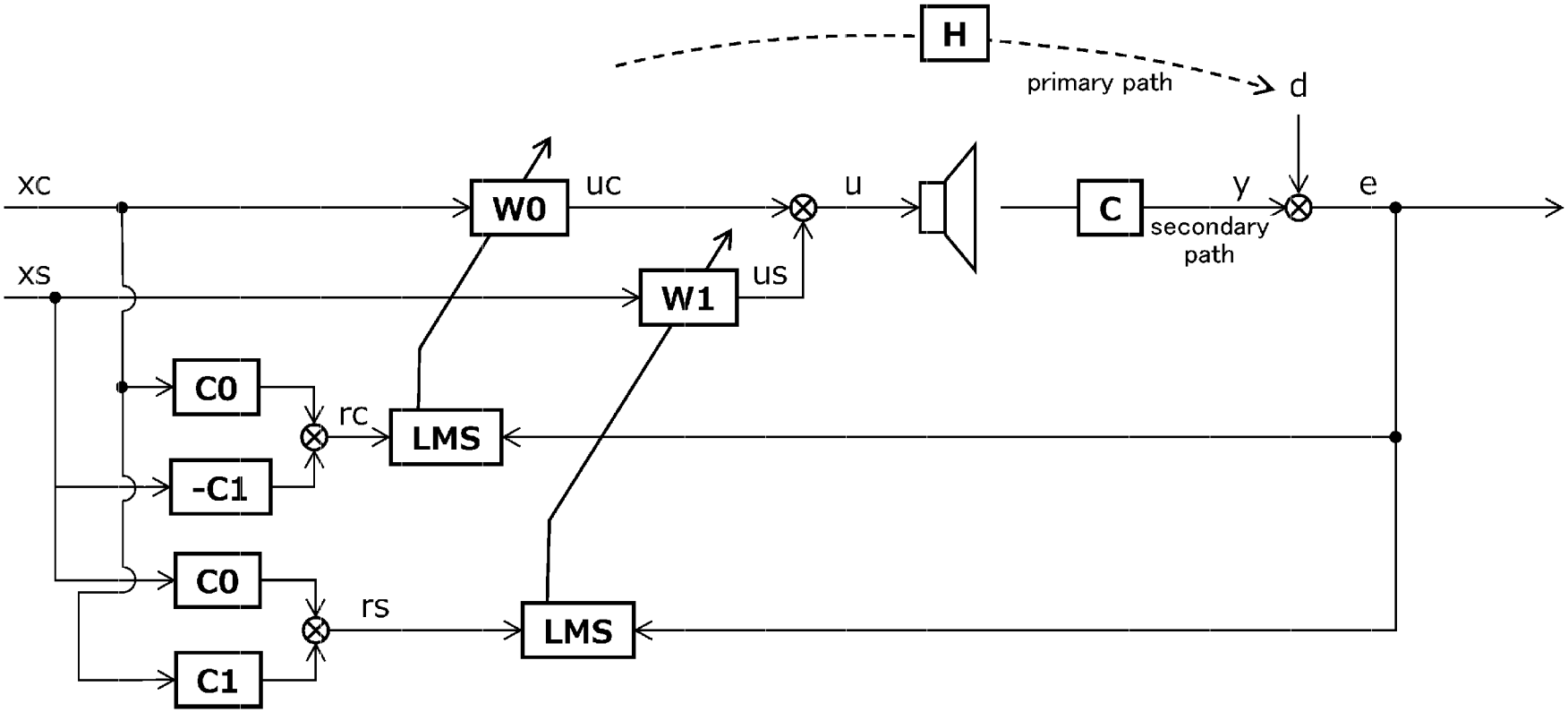
FIG. 7 is a block diagram of the LMS algorithm using XAT-based adaptive notch filters.
Figure 9:
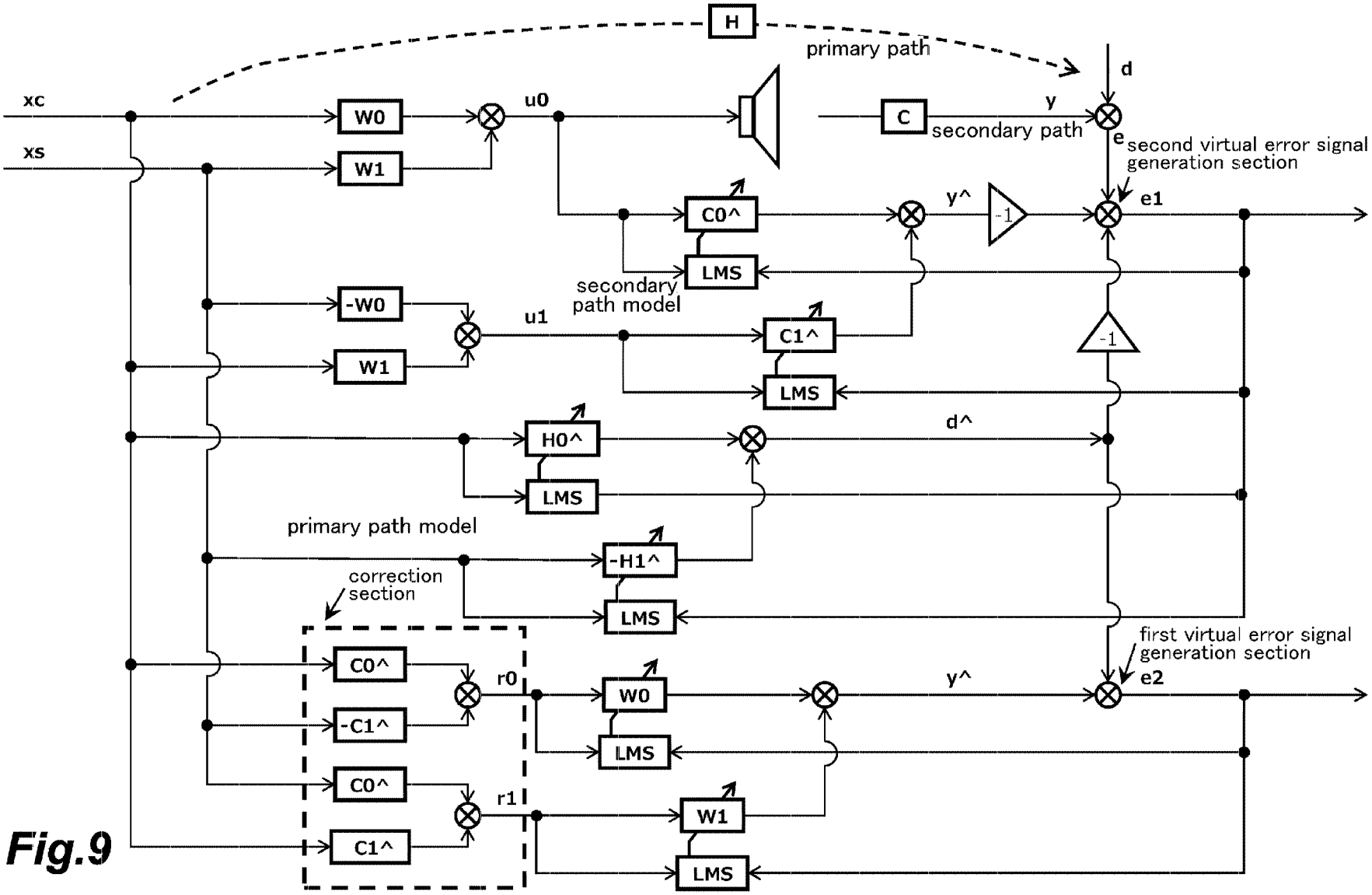
FIG. 9 is a block diagram of a vibratory noise reduction system optimally modeled according to the direct adaptive algorithm using adaptive notch filters.

FIG. 9 is a block diagram showing a vibratory noise reduction system optimally modeled according to the direct adaptive algorithm using SAN filters, based on FIG. 1 which is a block diagram showing the general direct adaptive algorithm using FIR filters. The two virtual error signals, the filter coefficient update formulas for the three adaptive notch filters, the canceling vibratory noise estimation signal, and the vibratory noise estimation signal are defined as follows.

$$\begin{aligned} e1(n) &= e(n) - C0(n)*[W0(n)*xc(n)+W1(n)*xs(n)] - \\ &\quad C1(n)*[W0(n)*xs(n)-W1(n)*xc(n)] - [ \\ &\quad H0(n)*xc(n)+H1(n)*xs(n)] \end{aligned} \tag{I}$$

$$\begin{aligned} e2(n) &= [H0(n)*xc(n)+H1(n)*xs(n)] + \\ &\quad W0(n)*[C0(n)*xc(n)+C1(n)*xs(n)] + \\ &\quad W1(n)*[C0(n)*xs(n)-C1(n)*xc(n)] \end{aligned} \tag{II}$$

$$\left.\begin{aligned} H0(n+1) &= H0(n)-\mu_{h0}*e1(n)*xc(n) \\ H1(n+1) &= H1(n)-\mu_{h1}*e1(n)*xs(n) \end{aligned}\right\} \tag{III}$$

$$\left.\begin{aligned} C0(n+1) &= C0(n)-\mu_{c0}*e1(n)*[W0(n)*xc(n)+W1(n)*xs(n)] \\ C1(n+1) &= C1(n)-\mu_{c1}*e1(n)*[W0(n)*xs(n)-W1(n)*xc(n)] \end{aligned}\right\} \tag{IV}$$

$$\left.\begin{aligned} W0(n+1) &= W0(n)-\mu_{w0}*e2*[C0\hat{}(n)*xc(n)+C1\hat{}(n)*xs(n)] \\ W1(n+1) &= W1(n)-\mu_{w1}*e2*[C0\hat{}(n)*xs(n)-C1\hat{}(n)*xc(n)] \end{aligned}\right\} \tag{V}$$

$$d(n) = H0(n)*xc(n)+H1(n)*xs(n) \tag{VII}$$

$$\begin{aligned} y(n) &= C0(n)*[W0(n)*xc(n)+W1(n)*xs(n)] + \\ &\quad C1(n)*[W0(n)*xs(n)-W1(n)*xc(n)] \end{aligned} \tag{VI}$$

Specifically, the block diagram of the vibratory noise reduction system optimally modeled according to the direct adaptive algorithm using SAN filters from the formulas (I) to (VII) is shown in FIG. 9.

The filter C^ corresponds to an estimated value (secondary path model) of the acoustic characteristics (signal transfer characteristics) from the loudspeaker to the error microphone, and therefore, the magnitude thereof changes depending on the frequency.

$$W0(n+1)=W0(n)-\mu_{w0}*e2*[C0\hat{}(n)*xc(n)+C1\hat{}(n)*xs(n)]=W0(n)-\mu_{w0}*e2*r0(n)$$

$$W1(n+1)=W1(n)-\mu_{w1}*e2*[C0\hat{}(n)*xs(n)-C1\hat{}(n)*xc(n)]=W1(n)-\mu_{w1}*e2*r1(n)$$

$$C0\hat{}(n+1)=C\hat{}(n)-\mu_{c0}*e1(n)*[W0(n)*xc(n)+W1(n)*xs(n)]=C0\hat{}(n)-\mu_{c0}*e1(n)*u0(n)$$

$$C1\hat{}(n+1)=C1\hat{}(n)-\mu_{c1}*e1(n)*[W0(n)*xs(n)-W1(n)*xc(n)]=C1\hat{}(n)-\mu_{c1}*e1(n)*u1(n)$$

If C^ is small, the reference signals (r0, r1) used in the update of the filter W become small, and the convergence of W becomes slow. Further, since the update of C^ uses the output of W, the convergence of C^ itself becomes slow. On the other hand, in the frequency band where C^ is large, the convergence of W and C^ is fast, but since the amount of update for each update is large, convergence to the optimal values cannot be ensured, which tends to make the control unstable.

By performing normalization of the magnitude of C^ and updating the filter coefficients based on only the phase of C^, a direct adaptive algorithm using SAN filters which can improve the convergence performance while ensuring the control stability irrespective of the magnitude of C^ is provided.

Note that "normalization" is normalization of the vector, namely, making the magnitude of the vector "1" while maintaining the direction of the vector.

$$z = a + ib$$

$$|z| = \sqrt{(a^2+b^2)}$$

$$\begin{aligned}|(z/|z|)| &= \sqrt{[(a/|z|)^2+(b/|z|)^2]}\\ &= \sqrt{\{[a/\sqrt{(a^2+b^2)}]^2+[b/\sqrt{(a^2+b^2)}]^2}\\ &= \sqrt{\{a^2/[\sqrt{(a^2+b^2)}]^2+b^2/[\sqrt{(a^2+b^2)}]^2\}}\\ &= \sqrt{\{a^2/(a^2+b^2)+b^2/(a^2+b^2)\}}\\ &= \sqrt{[(a^2+b^2)/(a^2+b^2)}\\ &= 1\end{aligned}$$

The normalization of C^ is performed in accordance with the following formulas.

$$C0\hat{}(n+1)=C0\hat{}(n)-\mu_{c0}*e1(n)*[W0(n)*xc(n)+W1(n)*xs(n)]=C0\hat{}(n)-\mu_{c0}*e1(n)*u0(n)$$

$$C1\hat{}(n+1)=C1\hat{}(n)-\mu_{c1}*e1(n)*[W0(n)*xs(n)-W1(n)*xc(n)]=C1\hat{}(n)-\mu_{c1}*e1(n)*u1(n)$$

$$C\hat{}(n+1)=C0\hat{}(n+1)-iC1\hat{}(n+1)$$

The amplitude (magnitude) of C^ (n+1), |C^ (n+1)|, is obtained by the following formula.

$$|C\hat{}(n+1)|=\sqrt{(C0\hat{}(n+1)^2+C1\hat{}(n+1)^2)}$$

Assuming that C^ (n+1) after the normalization is denoted by C'^ (n+1), C'^ (n+1) is obtained by the following formula.

$$C'\hat{}(n+1)=C0'\hat{}(n+1)-iC1'\hat{}(n+1)$$

$$C0'\hat{}(n+1)=C0\hat{}(n+1)/|C\hat{}(n+1)|$$

$$C1'\hat{}(n+1)=C1\hat{}(n+1)/|C\hat{}(n+1)|$$

The update of the filter coefficient (W (n+1)) of the control filter and the update of the next filter coefficient (C^ (n+2)) of the secondary path model are performed by using the normalized C'^ (n+1).

Instead of the above normalization, it is also possible to use the larger one of the absolute values of C0^ and C1^ to reduce the amount of calculation.

$$|C\hat{}(n+1)|\approx\max(|C0\hat{}(n+1)|,|C1\hat{}(n+1)|)$$

Next, variable step size parameters will be described.

The update of the filter coefficient is started with an initial value (small value such as "0") set beforehand, and therefore, at the start, the filter coefficient has a small value, and it is necessary to make the amount of update for each update large in order to achieve fast convergence to the optimal value. To increase the amount of update, it is necessary to set the step size parameter p to a large value. However, if u is set to a large value, it becomes difficult to ensure convergence to the optimal value and hence the control tends to be unstable. Thus, the convergence speed and the stability are in a tradeoff relationship.

Considering that the filter coefficient has a small value in the early stage of the update but increases toward the optimal value, there is provided a direct adaptive algorithm using SAN filters in which the value of the step size parameter for each filter coefficient is variable depending on the magnitude of the filter coefficient so that the convergence performance is improved while ensuring the control stability. The varying of the step size parameters may be performed by multiplying the step size parameter of the update formula for each adaptive notch filter by the multiplicative inverse of the amplitude of the adaptive notch filter immediately before the update or by multiplying the step size parameter of the update formula for each adaptive notch filter by the multiplicative inverse of the larger one of the absolute values of the two filter coefficients of the adaptive notch filter immediately before the update.

The update formulas using the fixed step size parameters are as follows.

$$H0\hat{}(n+1)=H0\hat{}(n)-\mu_{h0}*e1(n)*xc(n),H1\hat{}(n+1)=H1\hat{}(n)-\mu_{h1}*e1(n)*xs(n)$$

$$C0\hat{}(n+1)=C0\hat{}(n)-\mu_{c0}*e1(n)*u0(n),C1\hat{}(n+1)=C1\hat{}(n)-\mu_{c1}*e1(n)*u1(n)$$

$$W0(n+1)=W0(n)-\mu_{w0}*e2*r0(n),W1(n+1)=W1(n)-\mu_{w1}*e2*r1(n)$$

The concrete way of varying the step size parameters by multiplying the step size parameter of the update formula for each adaptive notch filter by the multiplicative inverse of the amplitude of the adaptive notch filter immediately before the update is as follows.

The amplitudes (magnitudes) of the respective adaptive notch filters, |H^ (n)|, |C^ (n)|, and |W (n)|, are obtained by the following formulas.

$$|H\hat{}(n)|=\sqrt{(H0\hat{}(n)^2+H1\hat{}(n)^2)}$$

$$|C\hat{}(n)|=\sqrt{(C0\hat{}(n)^2+C1\hat{}(n)^2)}$$

$$|W(n)|=\sqrt{(W0(n)^2+W1(n)^2)}$$

Thus, the variable step size parameters of the respective update formulas are calculated by the following formulas.

$$\mu_{Nh0}=\mu_{Nh0}/|H\hat{}(n)|=\mu_{h0}/\sqrt{(H0\hat{}(n)^2+H1\hat{}(n)^2)},\mu_{Nh1}=\mu_{h1}/|H\hat{}(n)|=\mu_{h1}/\sqrt{(H0\hat{}(n)^2+H1\hat{}(n)^2)}$$

$$\mu_{Nc0}=\mu_{c0}/|C\hat{}(n)|=\mu_{c0}/\sqrt{(C0\hat{}(n)^2+C1\hat{}(n)^2)},\mu_{Nc1}=\mu_{c1}/|C\hat{}(n)|=\mu_{c1}/\sqrt{(C0\hat{}(n)^2+C1\hat{}(n)^2)}$$

$$\mu_{Nw0}=\mu_{w0}/|W(n)|=\mu_{w0}/\sqrt{(W0(n)^2+W1\hat{}(n)^2)},\mu_{Nw0}=\mu_{w0}/|W(n)|=\mu_{w0}/\sqrt{(W0(n)^2+W1(n)^2)}$$

The update formulas using the variable step size parameters are as follows.

$$H0\hat{}(n+1)=H0\hat{}(n)-\mu_{Nh0}*e1(n)*xc(n),H1\hat{}(n+1)=H1\hat{}(n)-\mu_{Nh1}*e1(n)*xs(n)$$

$$C0\hat{}(n+1)=C0\hat{}(n)-\mu_{Nc0}*e1(n)*u0(n),C1\hat{}(n+1)=C1\hat{}(n)-\mu_{Nc1}*e1(n)*u1(n)$$

$$W0(n+1)=W0(n)-\mu_{Nw0}*e2*r0(n),W1(n+1)=W1(n)-\mu_{Nw1}*e2*r1(n)$$

The concrete way of varying the step size parameters by multiplying the step size parameter of the update formula for each adaptive notch filter by the multiplicative inverse of the larger one of the absolute values of the two filter coefficients of the adaptive notch filter immediately before the update is as follows.

The amplitudes (magnitudes) of the respective adaptive notch filters, |H^ (n)|, |C^ (n)|, and |W (n)|, are obtained by the following formulas.

$$|H\hat{}(n)|\approx\max(|H0\hat{}(n),|H1\hat{}(n)|)$$

$$|C\hat{}(n)|\approx\max(|C0\hat{}(n),|C1\hat{}(n)|)$$

$$|W(n)|\approx\max(|W0(n),|W1(n)|)$$

Thus, the variable step size parameters of the respective update formulas are calculated by the following formulas.

$$\mu_{Nh0}=\mu_{h0}/|H\hat{}(n)|,\mu_{Nh1}=\mu_{h1}/|H\hat{}(n)|$$

$$\mu_{Nc0}=\mu_{c0}/|C\hat{}(n)|,\mu_{Nc1}=\mu_{c1}/|C\hat{}(n)|$$

$$\mu_{Nw0}=\mu_{w0}/|W(n)|,\mu_{Nw0}=\mu_{w0}/|W(n)|$$

The update formulas using the variable step size parameters are as follows.

$$H0\hat{}(n+1)=H0\hat{}(n)-\mu_{Nh0}*e1(n)*xc(n),H1\hat{}(n+1)=H1\hat{}(n)-\mu_{Nh1}*e1(n)*xs(n)$$

$$C0\hat{}(n+1)=C0\hat{}(n)-\mu_{Nc0}*e1(n)*u0(n),C1\hat{}(n+1)=C1\hat{}(n)-\mu_{Nc1}*e1(n)*u1(n)$$

$$W0(n+1)=W0(n)-\mu_{Nw0}*e2*r0(n),W1(n+1)=W1(n)-\mu_{Nw1}*e2*r1(n)$$

As described above, in the active vibratory noise reduction system, the standard signal generation section generates, as standard signals, the standard sine wave signal xs and the standard cosine wave signal xc having a frequency in accordance with the frequency of vibratory noise generated from the vibratory noise source. The first adaptive notch control filter W0 outputs the first control signal uc based on the standard cosine wave signal xc, and the second adaptive notch control filter W1 outputs the second control signal us based on the standard sine wave signal xs. The vibratory noise canceler outputs the canceling vibratory noise based on the first addition signal u0 obtained by adding the first control signal uc and the second control signal us. The error signal detector outputs the error signal e based on the difference between the vibratory noise generated from the vibratory noise source and the canceling vibratory noise output from the vibratory noise canceler. The correction section generates the first and second reference signals r0, r1 by correcting the standard cosine wave signal xc and the standard sine wave signal xs with the first correction filter C^0 and the second correction filter C^1 corresponding to the signal transfer characteristics from the vibratory noise canceler to the error signal detector for the frequency of the standard signals.

The first estimation signal generation section corrects the standard cosine wave signal xc and the standard sine wave signal xs with the third correction filter H0 and the fourth correction filter H1 to obtain the first and second vibratory noise estimation signals, respectively, and generates the vibratory noise estimation signal d^ by adding the first vibratory noise estimation signal and the second vibratory noise estimation signal. The second estimation signal generation section generates the first canceling vibratory noise estimation signal y^ by adding the first corrected control signal obtained by correcting the standard cosine wave signal xc with the first correction filter C^0 and the first adaptive notch control filter W0, the second corrected control signal obtained by correcting the standard sine wave signal xs with the second correction filter C^1 and the first adaptive notch control filter W0, the third corrected control signal obtained by correcting the standard sine wave signal xs with the first correction filter C^0 and the second adaptive notch control filter W1, and the fourth corrected control signal obtained by correcting the standard cosine wave signal xc with the second correction filter C^1 and the second adaptive notch control filter W1. The first virtual error signal generation section generates the first virtual error signal e2 from the vibratory noise estimation signal d^ and the first canceling vibratory noise estimation signal y^. The first filter coefficient updating section sequentially updates the filter coefficients of the first and second adaptive notch control filters W0, W1 based on the first and second reference signals r0, r1 and the first virtual error signal e2 such that the first virtual error signal e2 is minimized.

The first adaptive notch control filter W0 outputs the third control signal based on the standard sine wave signal xs, and the second adaptive notch control filter W1 outputs the fourth control signal based on the standard cosine wave signal xc. The first correction filter C^0 is configured by the first adaptive notch correction filter C^0, and the second correction filter C^1 is configured by the second adaptive notch correction filter C^1. The third estimation signal generation section generates the second canceling vibratory noise estimation signal y^ by adding the fifth corrected control signal, which is obtained by correcting the first addition signal u0 with the first adaptive notch correction filter C^0 and the sixth corrected control signal, which is obtained by correcting, with the second adaptive notch correction filter C^1, the second addition signal u1 obtained by adding the third control signal and the fourth control signal. The second virtual error signal generation section generates the second virtual error signal e1 from the error signal e, the vibratory noise estimation signal d^, and the second canceling vibratory noise estimation signal y^. The second filter coefficient updating section sequentially updates the filter coefficients of the first and second adaptive notch correction filters C^0, C^1 based on the first control signal uc, the second control signal us, the third control signal, the fourth control signal, and the second virtual error signal e1 such that the second virtual error signal e1 is minimized.

The third correction filter H0 is configured by the third adaptive notch correction filter H0, and the fourth correction filter H1 is configured by the fourth adaptive notch correction filter H1. The third filter coefficient updating section sequentially updates the filter coefficients of the third and fourth adaptive notch correction filters H0, H1 based on the standard sine wave signal xs, the standard cosine wave signal xc, and the second virtual error signal e1 such that the second virtual error signal e1 is minimized.

The normalization section calculates the first and second normalized filter coefficients by multiplying the filter coefficients of the first and second adaptive notch correction filters by the multiplicative inverse of the square root of sum of squares of the filter coefficients of the first and second adaptive notch correction filters, respectively. The correction section generates the first and second reference signals r0, r1 by correcting the standard cosine wave signal xc and the standard sine wave signal xs with the first adaptive notch correction filter having the first normalized filter coefficient and the second adaptive notch correction filter having the second normalized filter coefficient.

The normalization section may calculate the third and fourth normalized filter coefficients by multiplying the filter coefficients of the first and second adaptive notch correction filters C^0, C^1 by the multiplicative inverse of the larger one of the absolute values of the filter coefficients of the first and second adaptive notch correction filters C^0, C^1. In this case, the correction section generates the first and second reference signals r0, r1 by correcting the standard cosine wave signal xc and the standard sine wave signal xs based on the first adaptive notch correction filter having the third normalized filter coefficient and the second adaptive notch correction filter having the fourth normalized filter coefficient.

Each of the first, second, and third filter coefficient updating sections determines the step size parameter p for controlling the amount of update of the filter coefficients of the adaptive notch filter updated thereby based on the square root of sum of squares of the filter coefficients immediately before the update.

Each of the first, second, and third filter coefficient updating section may determine the step size parameter p for controlling the amount of update of the filter coefficients of the adaptive notch filter updated thereby based on the larger one of the absolute values of the filter coefficients immediately before the update.

Next, with reference to FIGS. 10 to 12, first to third application examples of an active vibratory noise reduction system 10 according to the present invention will be described. In these examples, the active vibratory noise reduction system 10 is applied to a vehicle 1.

Figure 10:
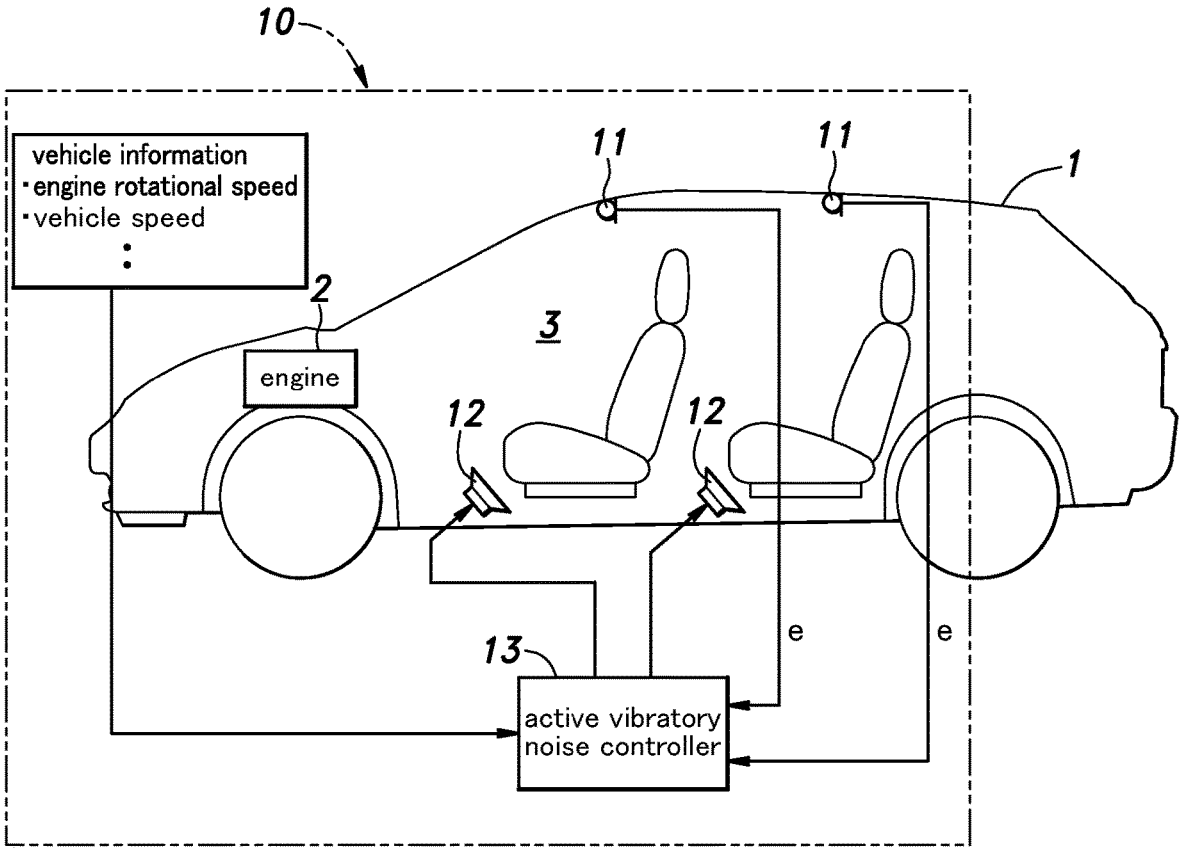
FIG. 10 is a configuration diagram showing a first application example of an active vibratory noise reduction system according to the present invention.

As shown in FIG. 10, the vehicle 1 has an engine 2 mounted thereon as a travel drive source. The active vibratory noise reduction system 10 includes error microphones 11 that serve as a vibratory noise detection unit configured to detect the noise in a passenger compartment 3, loudspeakers 12 that serve as a canceling sound generator configured to generate, as control sound for canceling the noise, canceling sound that is in opposite phase with the noise, and an active vibratory noise controller 13. The error microphones 11 are placed on the ceiling above the front seats and above the rear seats, for example. The loudspeakers 12 may be the loudspeakers of an audio system such as door loudspeakers mounted in the front doors and the rear doors. Each error microphone 11 functions as an error signal detector configured to detect, as an error signal e, the canceling error between the noise from the engine 2, which is a vibratory noise source, and the canceling sound from the loudspeakers 12. The active vibratory noise controller 13 is supplied with vehicle information, such as an engine rotational speed and a vehicle speed, and the error signal e detected by each error microphone 11. The active vibratory noise controller 13 generates a control signal u0 (first addition signal) for driving each loudspeaker 12 based on the vehicle information and the error signal e to control the canceling sound generated by the loudspeaker 12 so that the engine noise (engine muffling sound) transmitted to a vehicle occupant due to vibration of the engine 2 is reduced. In this case, the active vibratory noise controller 13 functions as an active noise controller.

Figure 11:
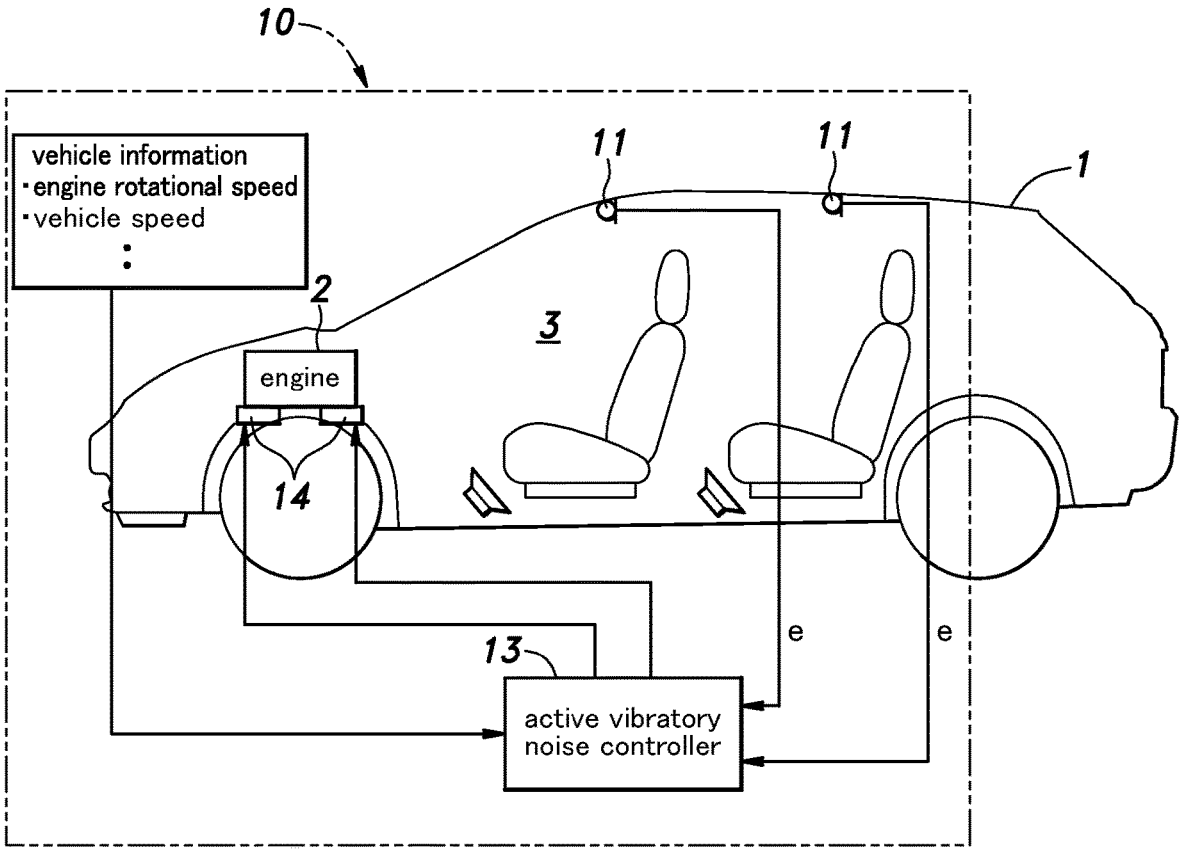
FIG. 11 is a configuration diagram showing a second application example of the active vibratory noise reduction system according to the present invention.

The active vibratory noise reduction system 10 shown in FIG. 11 includes error microphones 11 for detecting the noise in the passenger compartment 3, a vibration actuator 14 that serves as a canceling vibration generator configured to generate canceling vibration for canceling the vibration of the engine 2 which causes noise, and an active vibratory noise controller 13. The canceling vibration generated by the vibration actuator 14 is in opposite phase with the vibration of the engine 2. The error microphone 11 are similar to those of the active vibratory noise reduction system 10 shown in FIG. 10. The vibration actuator 14 is configured such that the generated canceling vibration is applied to the engine 2, and is constituted of an active engine mount, for example. The active vibratory noise controller 13 is supplied with the vehicle information, such as the engine rotational speed and the vehicle speed, and the error signal e detected by each error microphone 11. The active vibratory noise controller 13 generates the control signal u0 for driving the vibration actuator 14 based on the vehicle information and the error signal e to control the canceling vibration generated by the vibration actuator 14 so that the vibration of the engine 2 is reduced and the engine noise (engine muffling sound) transmitted to the vehicle occupant due to the vibration of the engine 2 is reduced. In this case, the active vibratory noise controller 13 functions as an active vibration controller.

Figure 12:
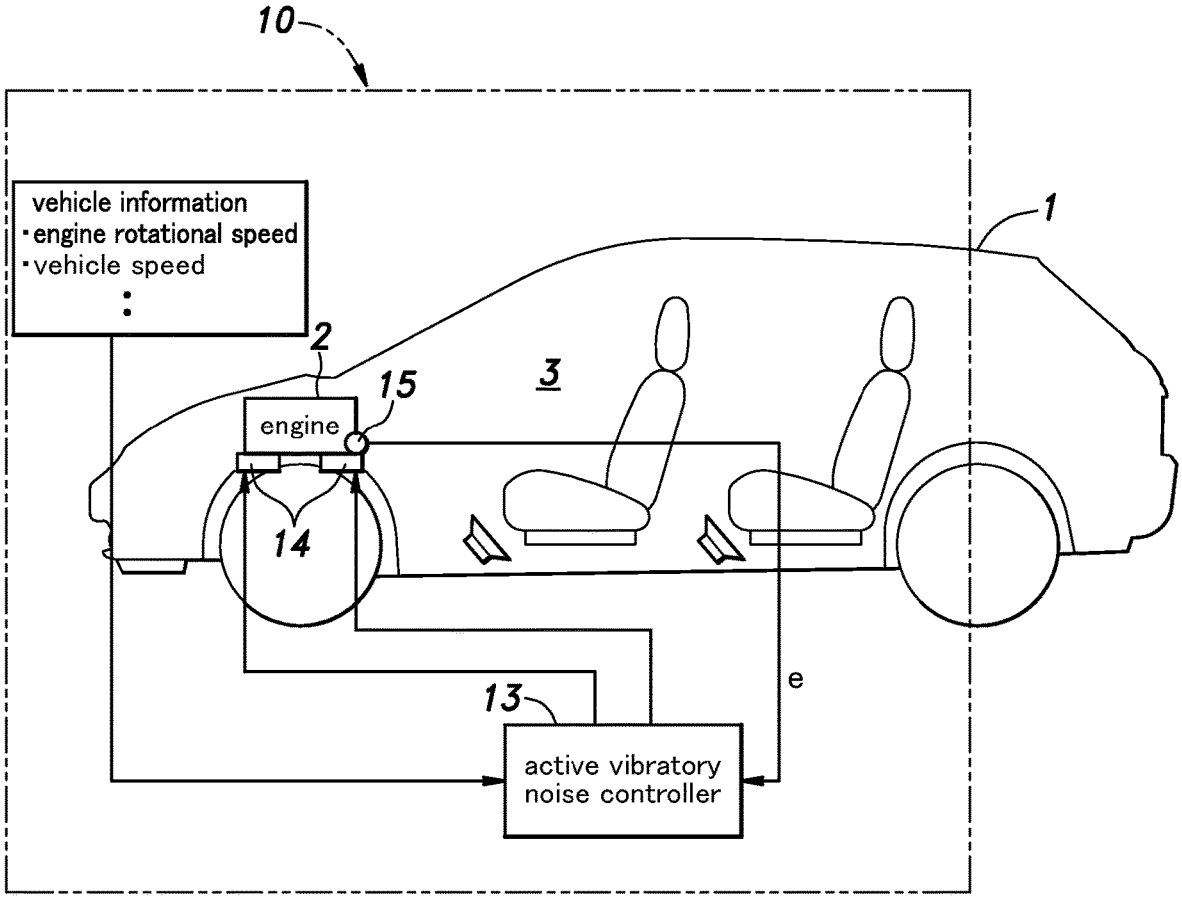
FIG. 12 is a configuration diagram showing a third application example of the active vibratory noise reduction system according to the present invention.

The active vibratory noise reduction system 10 shown in FIG. 12 includes a vibration sensor 15 that serves as a vibratory noise detection unit configured to detect the vibration of the engine 2 which causes noise in the passenger compartment 3, a vibration actuator 14 configured to generate the canceling vibration to cancel the vibration of the engine 2, and an active vibratory noise controller 13. The vibration sensor 15 is mounted on the engine 2, and functions as an error signal detector configured to detect, as an error signal e, an error vibration which is a synthesis of the engine vibration generated by the rotation of the engine 2 and the canceling vibration applied to the engine 2 by the vibration actuator 14. The vibration actuator 14 may be similar to that of the active vibratory noise reduction system 10 shown in FIG. 11. The active vibratory noise controller 13 is supplied with the vehicle information, such as the engine rotational speed and the vehicle speed, and the error signal e detected by the vibration sensor 15. The active vibratory noise controller 13 generates the control signal u0 for driving the vibration actuator 14 based on the vehicle information and the error signal e to control the canceling vibration generated by the vibration actuator 14 so that the vibration of the engine 2 is reduced and the engine noise (engine muffling sound) transmitted to the vehicle occupant due to the vibration of the engine 2 is reduced. In this case also, the active vibratory noise controller 13 functions as an active vibration controller.

As described above, the active vibratory noise reduction system 10 according to the present invention can be used in various modes. Other than the above examples, for example, an electric motor may be mounted instead of the engine 2 as a drive source, and the active vibratory noise reduction system 10 may be configured to reduce the vibratory noise generated from the electric motor. In yet another embodiment, the active vibratory noise reduction system 10 may be configured to reduce drive system noise transmitted to the vehicle occupant due to the vibratory noise generated from drive system rotating bodies, such as a propeller shaft and a drive shaft, during travel of the vehicle 1. Thus, the active vibratory noise reduction system 10 can reduce the vibratory noise of the engine 2 or the drive system, which generates periodic and narrow-band vibratory noise due to rotational motion of the rotating bodies.

In each embodiment described in the following, the vehicle 1 is provided with the engine 2 as a drive source, the active vibratory noise reduction system 10 is provided with the error microphone 11 as a vibratory noise detection unit and the loudspeaker 12 as a canceling sound generator, and the active vibratory noise controller 13 functions as an active noise controller.

First Embodiment

Figure 13:
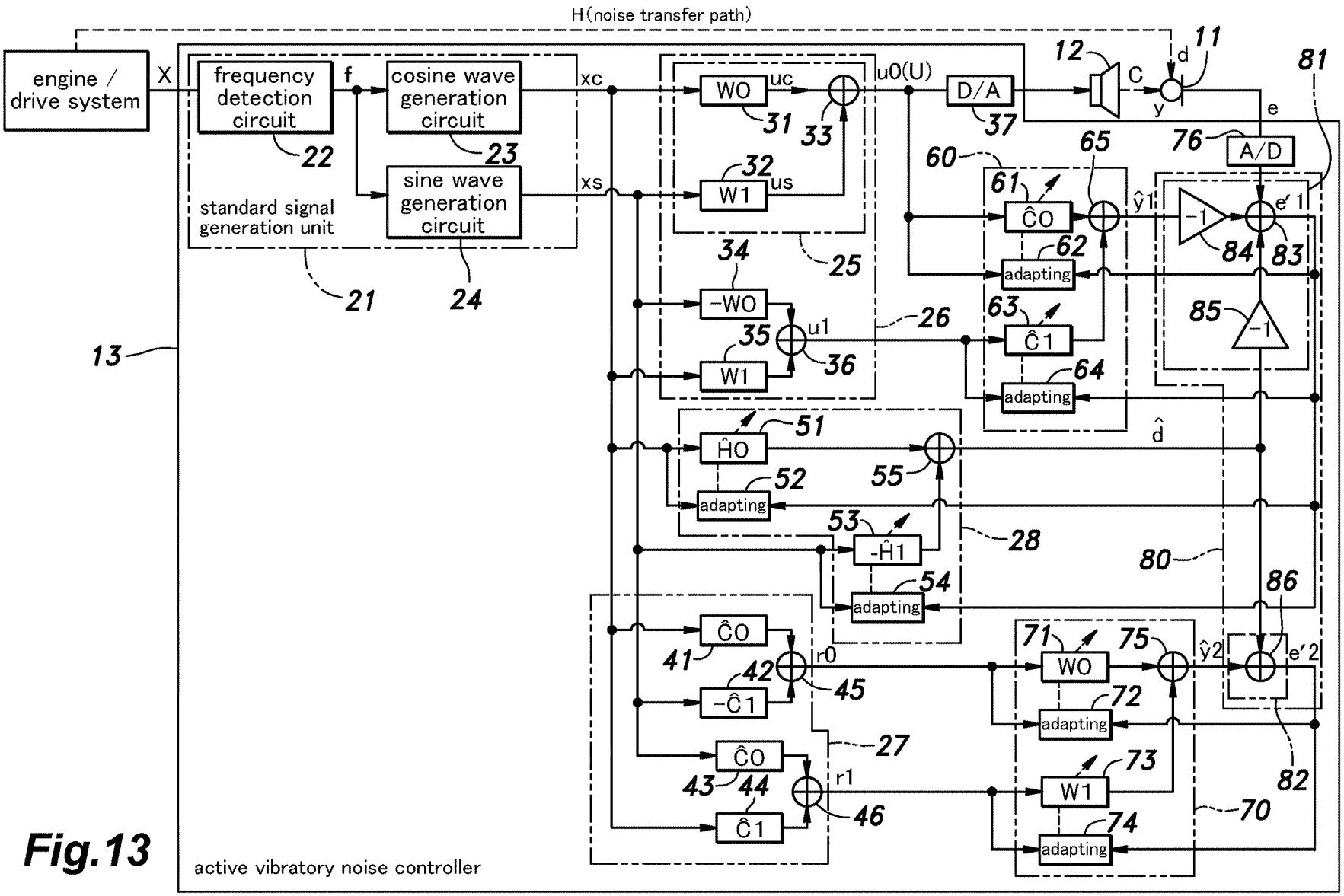
FIG. 13 is a functional block diagram of the active vibratory noise reduction system according to the first embodiment.
Figure 14:
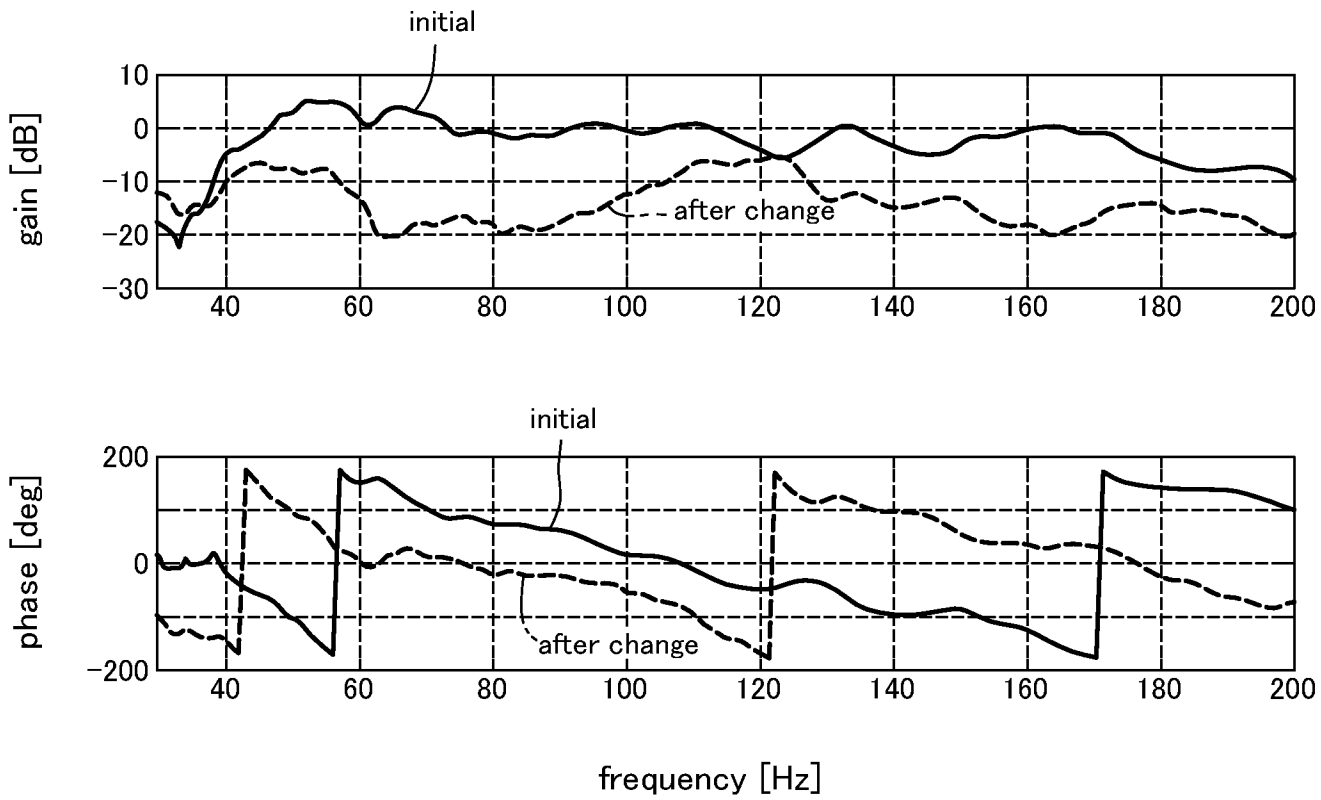
FIG. 14 is a graph showing a change in the acoustic characteristics assumed to occur.
Figure 15:
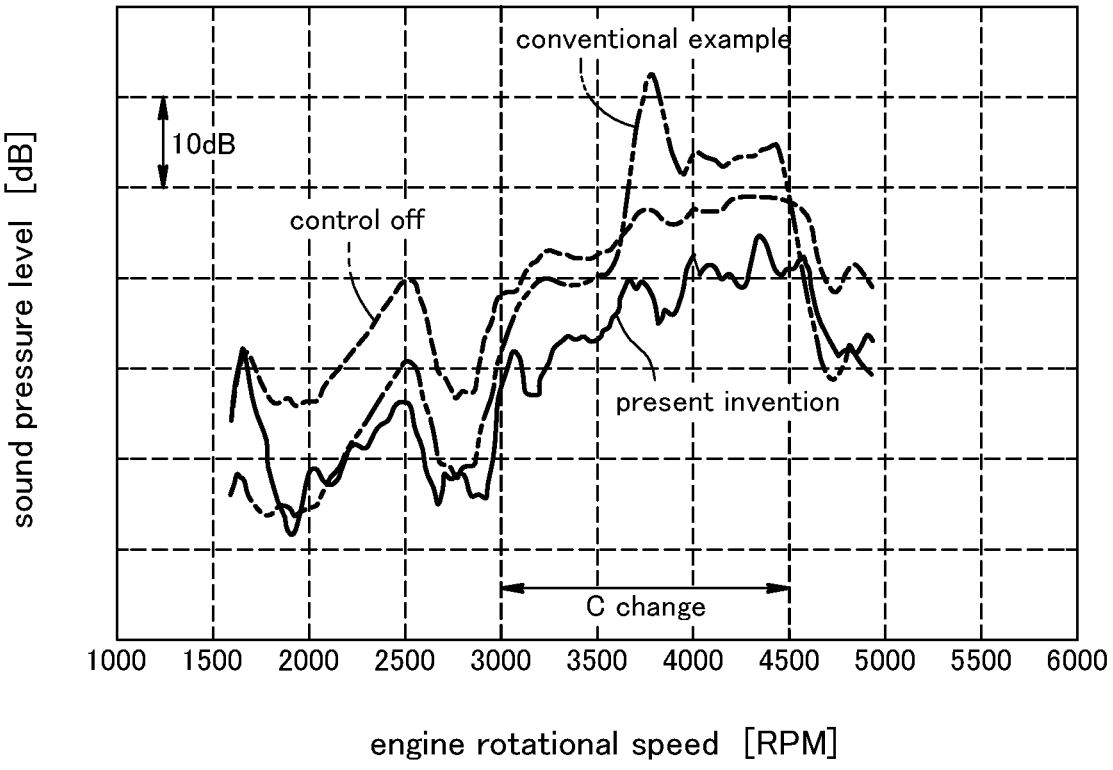
FIG. 15 is a graph showing the sound pressure level of the engine muffling sound in the active vibratory noise reduction system according to the first embodiment in comparison with when the control is off and with the conventional example.

With reference to FIGS. 13 to 15, a first embodiment of the present invention will be described. FIG. 13 is a functional block diagram of the active vibratory noise reduction system 10 according to the first embodiment. As shown in FIG. 13, the active vibratory noise controller 13 is supplied with an engine/drive system signal X. The engine/drive system signal X may be engine pulses that are synchronous with the vibration frequency, such as the rotation frequency of the output shaft of the engine 2, or rotation pulses of the drive system for transmitting the driving force of the engine 2 to the wheels. The engine/drive system signal X is not limited to these, and may be any operation-related information of the vehicle information, namely, information related to operation of the drive source or the drive system, which can be a vibratory noise source. Such operation-related information may be, for example, the rotation speed of the engine 2, the vehicle speed, the motor rotation speed, the gear rotation speed based on the gear stage (transmission) information, or the like. The active vibratory noise controller 13 includes a standard signal generation unit 21 configured to generate standard signals x (xc, xs) based on the engine/drive system signal X.

In the standard signal generation unit 21, a frequency estimation circuit 22 estimates, from the engine/drive system signal X, the frequency f of vibratory noise d that makes the noise in the passenger compartment 3. Specifically, the frequency estimation circuit 22 estimates the frequency f of the vibratory noise d based on the engine/drive system signal X by referring to a map. The estimated frequency f is supplied to a cosine wave generation circuit 23 and a sine wave generation circuit 24. The cosine wave generation circuit 23 generates, based on the supplied frequency f, a standard cosine wave signal xc which is a standard signal x synchronous with the vibratory noise d generated from the engine 2/drive system due to rotation of the engine 2. The sine wave generation circuit 24 generates, based on the supplied frequency f, a standard sine wave signal xs which is a standard signal x synchronous with the vibratory noise d. In other words, the standard signal generation unit 21 generates the standard signals x (xc, xs) having the frequency f of the vibratory noise d that is estimated based on the operation-related information of the engine 2/drive system, instead of generating the standard signals x (xc, xs) by detecting the frequency f from the physical quantity of the vibratory noise d detected by the microphone or the vibration sensor. The standard signals x (xc, xs) generated by the standard signal generation unit 21 are supplied to a control signal generation unit 25, a standard signal correction unit 26, a reference signal generation unit 27 (correction section), and a vibratory noise estimation signal generation unit 28 (first estimation signal generation section).

The control signal generation unit 25 is a notch filter for generating the control signal u0 by filtering the standard signals x (xc, xs), and has an adaptive notch filter coefficient W represented by a single complex number. This adaptive notch filter coefficient W indicates the circuit characteristics of the control signal generation unit 25. The control signal generation unit 25 includes a first adaptive notch control filter 31 having a first adaptive notch filter coefficient W0, which is the real part of the adaptive notch filter coefficient W, a second adaptive notch control filter 32 having a second adaptive notch filter coefficient W1, which is the imaginary part of the adaptive notch filter coefficient W, and an adder 33. The standard cosine wave signal xc is supplied to the first adaptive notch control filter 31 and is filtered by using the first adaptive notch filter coefficient W0. The standard sine wave signal xs is supplied to the second adaptive notch control filter 32 and is filtered by using the second adaptive notch filter coefficient W1. A first control signal uc output from the first adaptive notch control filter 31 and a second control signal us output from the second adaptive notch control filter 32 are added at the adder 33 to generate the control signal u0. The control signal generation unit 25 constitutes a part of the standard signal correction unit 26, and the standard signals x (xc, xs) are corrected with the circuit characteristics (the adaptive notch filter coefficient W) of the control signal generation unit 25 to generate the control signal u0 (first addition signal).

The standard signal correction unit 26 is an adaptive notch filter that includes, in addition to the above-described control signal generation unit 25, a first adaptive notch filter 34 having the first adaptive notch filter coefficient W0, a second adaptive notch filter 35 having a coefficient obtained by reversing the polarity of the second adaptive notch filter coefficient W1, and an adder 36. The standard cosine wave signal xc is supplied to the first adaptive notch filter 34 and is filtered by using the first adaptive notch filter coefficient W0. The standard sine wave signal xs is supplied to the second adaptive notch filter 35 and is filtered by using the coefficient that is the second adaptive notch filter coefficient W1 with reversed polarity. A third control signal output from the first adaptive notch filter 34 and a fourth control signal output from the second adaptive notch filter 35 are added at the adder 36 to generate a control signal u1 (second addition signal).

The control signal u0 output from the control signal generation unit 25 is converted to an analog signal at a D/A converter 37 and thereafter is supplied to the loudspeaker 12. The loudspeaker 12 generates, based on the supplied control signal u0, the canceling sound (control sound) for canceling the noise generated from the engine 2/drive system, which is a noise source.

In the reference signal generation unit 27, a canceling sound transfer characteristics estimated value Cˆ, which is an estimated value of the acoustic characteristics C for the canceling sound from the loudspeaker 12 to the error microphone 11, is set. The canceling sound transfer characteristics estimated value Cˆ is a value provided by a first adaptive notch correction filter unit 60, which will be described later. The canceling sound transfer characteristics estimated value Cˆ is represented by a single complex number obtained for the frequency f of the canceling sound according to a function setting the transfer characteristics (amplitude characteristics and phase characteristics) from the loudspeaker 12 to the error microphone 11, and has a real part Cˆ0 (first correction filter coefficient) and an imaginary part C^1 (second correction filter coefficient).

In the reference signal generation unit 27, the standard cosine wave signal xc is input to a first correction filter 41 having the real part C^0 of the canceling sound transfer characteristics estimated value C^ as a coefficient thereof. The standard sine wave signal xs is input to a second correction filter 42 having the imaginary part C^1 of the canceling sound transfer characteristics estimated value C^ as a coefficient thereof. Also, the standard sine wave signal xs is input to a first correction filter 43 having the real part C^0 of the canceling sound transfer characteristics estimated value C^ as a coefficient thereof. The standard cosine wave signal xc is input to a second correction filter 44 having the polarity-reversed imaginary part C^1 of the canceling sound transfer characteristics estimated value C^ as a coefficient thereof.

The standard cosine wave signal xc is filtered by the first correction filter 41 by using the real part C^0 of the canceling sound transfer characteristics estimated value C^. The standard sine wave signal xs is filtered by the second correction filter 42 by using the imaginary part C^1 of the canceling sound transfer characteristics estimated value C^. The output of the first correction filter 41 and the output the second correction filter 42 are added at an adder 45, whereby the standard signals x (xc, xs) are corrected with the canceling sound transfer characteristics estimated value C^ to generate a first reference signal r0. Also, the standard cosine wave signal xc is filtered by the first correction filter 43 by using the real part C^0 of the canceling sound transfer characteristics estimated value C^. The standard sine wave signal xs is filtered by the second correction filter 44 by using the polarity-reversed imaginary part C^1 of the canceling sound transfer characteristics estimated value C^. The output of the first correction filter 43 and the output of the second correction filter 44 are added at an adder 46, whereby the standard signals x (xc, xs) are corrected with the canceling sound transfer characteristics estimated value C^ to generate a second reference signal r1.

The vibratory noise estimation signal generation unit 28 is a so-called Single frequency Adaptive Notch (SAN) filter. In the vibratory noise estimation signal generation unit 28, a small value such as 0 is set as an initial value of a transfer characteristics estimated value H^, which is an estimated value of the transfer characteristics H for noise from the engine 2/drive system, which is a noise source, to the error microphone 11 (namely, a noise propagation path). The transfer characteristics estimated value H^ is represented by a single complex number obtained for the frequency f of the vibratory noise d according to a function setting the transfer characteristics (amplitude characteristics and phase characteristics) from the noise source to the error microphone 11, and has a real part H^0 (third correction filter coefficient (third adaptive notch correction filter coefficient)) and an imaginary part H^1 (fourth correction filter coefficient (fourth adaptive notch correction filter coefficient)). The transfer characteristics estimated value H^ is not a physical quantity obtained by directly measuring the vibration frequency of the noise source but is generated from the standard signals x generated based on the aforementioned operation-related information of the engine 2/drive system.

In the vibratory noise estimation signal generation unit 28, the standard cosine wave signal xc input to a third adaptive notch correction filter 51 having the real part H^0 of the transfer characteristics estimated value H^ as a coefficient thereof and a filter coefficient updating unit 52 (third filter coefficient updating section) for adaptively updating the filter coefficient of the third adaptive notch correction filter 51. The standard sine wave signal xs is input to a fourth adaptive notch correction filter 53 having the imaginary part H^1 of the transfer characteristics estimated value H^ as a coefficient thereof and a filter coefficient updating unit 54 (third filter coefficient updating section) for adaptively updating the filter coefficient of the fourth adaptive notch correction filter 53. The third adaptive notch correction filter 51 and the fourth adaptive notch correction filter 53 are correction filters corresponding to the signal transfer characteristics of the primary path from the drive source or the drive system (vibratory noise source) to the error microphone 11 (error signal detector) for the frequency of the standard signals x and are adaptive notch correction filters whose filter coefficient is adaptively updated. Details of the filter coefficient updating unit 52 and the filter coefficient updating unit 54 will be described later.

The standard cosine wave signal xc is filtered by the third adaptive notch correction filter 51 by using the real part H^0 of the transfer characteristics estimated value H^. The standard sine wave signal xs is filtered by the fourth adaptive notch correction filter 53 by using the imaginary part H^1 of the transfer characteristics estimated value H^. The first vibratory noise estimation signal output from the third adaptive notch correction filter 51 and the second vibratory noise estimation signal output from the fourth adaptive notch correction filter 53 are added at an adder 55 to generate a vibratory noise estimation signal d^, which is an estimated value of the vibratory noise d reaching the error microphone 11. Namely, the vibratory noise estimation signal generation unit 28 generates the vibratory noise estimation signal d^ at the error microphone 11 based on the standard signals x (xc, xs).

The control signal u0 and the control signal u1 output from the standard signal correction unit 26 are supplied to the first adaptive notch correction filter unit 60 (third estimation signal generation section). The first adaptive notch correction filter unit 60 is a SAN filter, and in the first adaptive notch correction filter unit 60, a small value such as 0 is set before hand as an initial value of the canceling sound transfer characteristics estimated value C^. In the first adaptive notch correction filter unit 60, the control signal u0 is input to a first adaptive notch correction filter 61 having the real part C^0 of the canceling sound transfer characteristics estimated value C^ as a coefficient thereof and a filter coefficient updating unit 62 (second filter coefficient updating section) for adaptively updating the filter coefficient of the first adaptive notch correction filter 61. The control signal u1 is input to a second adaptive notch correction filter 63 having the imaginary part C^1 of the canceling sound transfer characteristics estimated value C^ as a coefficient thereof and a filter coefficient updating unit 64 (second filter coefficient updating section) for adaptively updating the filter coefficient of the second adaptive notch correction filter 63. The first adaptive notch correction filter 61 and the second adaptive notch correction filter 63 are correction filters and are adaptive notch correction filters whose filter coefficient is adaptively updated. Details of the filter coefficient updating unit 62 and the filter coefficient updating unit 64 will be described later.

The control signal u0 is filtered by the first adaptive notch correction filter 61 by using the real part C^0 of the canceling sound transfer characteristics estimated value C^. The control signal u1 is filtered by the second adaptive notch correction filter 63 by using the imaginary part C^1 of the canceling sound transfer characteristics estimated value C^. The first corrected control signal output from the first adaptive notch correction filter 61 and the second corrected control signal output from the second adaptive notch correction filter 63 are added at an adder 65 to generate a first estimated value y^1 of the canceling vibratory noise y (second canceling vibratory noise estimation signal) reaching the error microphone 11. Namely, the first adaptive notch correction filter unit 60 generates the first estimated value y^1 of the canceling sound reaching the error microphone 11 based on the control signal u0 and the control signal u1.

The first and second reference signals r0, r1 output from the reference signal generation unit 27 are supplied to a third adaptive notch filter 70 (second estimation signal generation section). The third adaptive notch filter 70 is a SAN filter. In the third adaptive notch filter 70, a small value such as 0 is set beforehand as an initial value of the adaptive notch filter coefficient W (W0, W1) representing the circuit characteristics of the control signal generation unit 25. In the third adaptive notch filter 70, the first reference signal r0 is input to a first adaptive notch control filter 71 having the first adaptive notch filter coefficient W0, which is the real part of the adaptive notch filter coefficient W, and a filter coefficient updating unit 72 (first filter coefficient updating section) for adaptively updating the filter coefficient of the first adaptive notch control filter 71. The second reference signal r1 is input to a second adaptive notch control filter 73 having the second adaptive notch filter coefficient W1, which is the imaginary part of the adaptive notch filter coefficient W, and a filter coefficient updating unit 74 (first filter coefficient updating section) for adaptively updating the filter coefficient of the second adaptive notch control filter 73. Details of the filter coefficient updating unit 72 and the filter coefficient updating unit 74 will be described later.

The first reference signal r0 is filtered by the first adaptive notch control filter 71 by using the first adaptive notch filter coefficient W0. The second reference signal r1 is filtered by the second adaptive notch control filter 73 by using the second adaptive notch filter coefficient W1. The output of the first adaptive notch control filter 71 and the output of the second adaptive notch control filter 73 are added at an adder 75 to generate a second estimated value y^2 of the canceling vibratory noise y at the error microphone 11 (first canceling vibratory noise estimation signal). Namely, the third adaptive notch filter 70 generates the second estimated value y^2 of the canceling sound reaching the error microphone 11 based on the first and second reference signals r0, r1.

The adaptive notch filter coefficient W (W0, W1) adaptively updated in the third adaptive notch filter 70 is provided to the control signal generation unit 25. Namely, the adaptive notch filter coefficient W (W0, W1) set in the control signal generation unit 25 is not a fixed value, and the values same as the values sequentially updated by the filter coefficient updating unit 72 and the filter coefficient updating unit 74 are adaptively set as the real part W0 and the imaginary part W1 of the adaptive notch filter coefficient W, respectively.

The error microphone 11 detects, as an error signal e, the noise in the passenger compartment 3, which is a canceling error noise resulting from the synthesis of the vibratory noise d mainly generated by the engine 2/drive system to have a frequency f and reaching the error microphone 11 and the canceling vibratory noise y generated by the loudspeaker 12 and reaching the error microphone 11. Note that the noise detected by the error microphone 11 includes not only the aforementioned canceling error noise but also the noise originating from parts other than the engine 2/drive system. The error signal e is converted to a digital signal at an A/D converter 76 and is thereafter supplied to a virtual error signal generation unit 80.

The vibratory noise estimation signal d^ at the error microphone 11, which is output from the vibratory noise estimation signal generation unit 28, is also supplied to the virtual error signal generation unit 80. Further, the first estimated value y^1 and the second estimated value y^2 of the canceling vibratory noise y reaching the error microphone 11, which are output from the first adaptive notch correction filter unit 60 and the third adaptive notch filter 70, respectively, are also supplied to the virtual error signal generation unit 80.

The virtual error signal generation unit 80 generates apparent virtual error signals e' (a second virtual error signal e'1 and a first virtual error signal e'2) based on the error signal e and the vibratory noise estimation signal d^ at the error microphone 11. Specifically, the virtual error signal generation unit 80 includes a second virtual error signal generation unit 81 configured to generate the second virtual error signal e'1 and a first virtual error signal generation unit 82 configured to generate the first virtual error signal e'2.

In the second virtual error signal generation unit 81, the error signal e is supplied to an adder 83. Also, the vibratory noise estimation signal d^ at the error microphone 11 is supplied to the adder 83 after the polarity thereof is reversed at a first polarity reversing circuit 84. Further, the first estimated value y^1 of the canceling vibratory noise y is supplied to the adder 83 after the polarity thereof is reversed at a second polarity reversing circuit 85. The adder 83 adds the supplied three values together to generate the second virtual error signal e'1. The second virtual error signal e'1 is supplied to the vibratory noise estimation signal generation unit 28 and the first adaptive notch correction filter unit 60.

In the first virtual error signal generation unit 82, the vibratory noise estimation signal d^ at the error microphone 11 is supplied to an adder 86. Also, the second estimated value y^2 of the canceling vibratory noise y is supplied to the adder 86. The adder 86 adds the supplied two values together to generate the first virtual error signal e'2. The first virtual error signal e'2 is supplied to the third adaptive notch filter 70.

The second virtual error signal e'1 and the first virtual error signal e'2 generated by the virtual error signal generation unit 80 can be represented by the below formulas.

$$e1_n=e_n-r_n*W_n*\hat{C}_n-r_n*\hat{H}_n, e2_n=r_n*\hat{H}_n+r_n*\hat{C}_n*W_n$$

Here, r is the reference signal (constituted of the standard cosine wave signal xc and the standard sine wave signal xs), * is filtering calculation (in the SAN filter, corresponds to multiplication of complex numbers), and n is sampling time.

In the vibratory noise estimation signal generation unit 28, the filter coefficient updating unit 52 calculates the filter coefficient (H^0) of the third adaptive notch correction filter 51 based on the standard cosine wave signal xc and the second virtual error signal e'1 such that the second virtual error signal e'1 is minimized according to the LMS algorithm. The filter coefficient updating unit 52 performs the coefficient calculation of the third adaptive notch correction filter 51 at each sampling time to update the filter coefficient (H^0) of the third adaptive notch correction filter 51 to the calculated value. Also, the filter coefficient updating unit 54 calculates the filter coefficient (H^1) of the fourth adaptive notch correction filter 53 based on the standard sine wave signal xs and the second virtual error signal e'1 such that the second virtual error signal e'1 is minimized according to the LMS algorithm. The filter coefficient updating unit 54 performs the coefficient calculation of the fourth adaptive notch correction filter 53 at each sampling time to update the filter coefficient (Ĥ1) of the fourth adaptive notch correction filter 53 to the calculated value. Namely, the vibratory noise estimation signal generation unit 28 constitutes an updating unit for updating the transfer characteristics estimated value Ĥ.

In the first adaptive notch correction filter unit 60, the filter coefficient updating unit 62 calculates the filter coefficient (Ĉ0) of the first adaptive notch correction filter 61 based on the control signal u0 and the second virtual error signal e'1 such that the second virtual error signal e'1 is minimized according to the LMS algorithm. The filter coefficient updating unit 62 performs the coefficient calculation of the first adaptive notch correction filter 61 at each sampling time to update the filter coefficient (Ĉ0) of the first adaptive notch correction filter 61 to the calculated value. Also, the filter coefficient updating unit 64 calculates the filter coefficient (Ĉ1) of the second adaptive notch correction filter 63 based on the control signal u1 and the second virtual error signal e'1 such that the second virtual error signal e'1 is minimized according to the LMS algorithm. The filter coefficient updating unit 64 performs the coefficient calculation of the second adaptive notch correction filter 63 at each sampling time to update the filter coefficient (Ĉ1) of the second adaptive notch correction filter 63 to the calculated value. Namely, the first adaptive notch correction filter unit 60 constitutes an updating unit for updating the canceling sound transfer characteristics estimated value Ĉ.

In the third adaptive notch filter 70, the filter coefficient updating unit 72 calculates the first adaptive notch filter coefficient W0 of the first adaptive notch control filter 71 based on the first reference signal r0 and the first virtual error signal e'2 such that the first virtual error signal e'2 is minimized according to the LMS algorithm. The filter coefficient updating unit 72 performs the coefficient calculation of the first adaptive notch control filter 71 at each sampling time to update the first adaptive notch filter coefficient W0 of the first adaptive notch control filter 71 to the calculated value. Also, the filter coefficient updating unit 74 calculates the second adaptive notch filter coefficient W1 of the second adaptive notch control filter 73 based on the second reference signal r1 and the first virtual error signal e'2 such that the first virtual error signal e'2 is minimized according to the LMS algorithm. The filter coefficient updating unit 74 performs the coefficient calculation of the second adaptive notch control filter 73 at each sampling time to update the second adaptive notch filter coefficient W1 of the second adaptive notch control filter 73 to the calculated value. Namely, the third adaptive notch filter 70 constitutes an updating unit for updating the adaptive notch filter coefficient W representing the circuit characteristics of the control signal generation unit 25.

The first adaptive notch filter coefficient W0 and the second adaptive notch filter coefficient W1 updated by the third adaptive notch filter 70 are provided to the control signal generation unit 25 as mentioned above, and the first adaptive notch filter coefficient W0 of the first adaptive notch control filter 31 and the second adaptive notch filter coefficient W1 of the second adaptive notch control filter 32 are sequentially updated.

Thereby, the standard cosine wave signal xc and the standard sine wave signal xs filtered by the control signal generation unit 25 are optimized, whereby the vibratory noise d, which is periodic noise from the engine 2/drive system is canceled by the control sound generated by the loudspeaker 12 based on the control signal u0 and the in-compartment noise is reduced.

The filter coefficients (Ĥ, Ĉ, W) of these adaptive notch filters (28, 60, 70) are updated by the LMS algorithm by using the virtual error signals e' (e'1, e'2), as follows.

$$\hat{H}0_{n+1}=\hat{H}0_n-\mu_H\times e1_n\times rc_n,\ \hat{H}1_{n+1}=\hat{H}1_n-\mu_H\times e1_n\times rs_n$$

$$\hat{C}0_{n+1}=\hat{C}0_n-\mu_c\times e1_n\times ur_n,\ \hat{C}1_{n+1}=\hat{C}1_n-\mu_c\times e1_n\times ui_n$$

$$W0_{n+1}=W0_n-\mu_W\times e2_n\times cr_n,\ W1_{n+1}=W1_n-\mu_W\times e2_n\times ci_n$$

Here, is a step size parameter for adjusting the amount of update of each adaptive filter coefficient.

When the second virtual error signal e'1 and the first virtual error signal e'2 converge to the minimum value (0) as a result of the foregoing adaptive update, the following simultaneous equations hold.

$$e_n-r_n*W_n*\hat{C}_n-r_n*\hat{H}_n=0, \tag{12}$$

$$r_n*\hat{H}_n+r_n*\hat{C}_n*W_n=0, \tag{13}$$

From the above formula (13), the below formula (14) is derived.

$$W_n=-\hat{H}_n/\hat{C}_n, \tag{14}$$

Also, from the above formula (14) and the above formula (12), the below formula (15) is derived.

$$H_n/C_n=\hat{H}_n/\hat{C}_n, \tag{15}$$

Here, / is division of complex numbers.

From the above formula (14) and the above formula (15), the below formula (16) is derived.

$$W_n=-H_n/C_n, \tag{16}$$

The error signal e indicating the sound pressure at the position of the error microphone 11 is represented by the below formula.

$$en=dn+yn=rn*Hn+rn*Wn*Cn$$

By substituting the above formula (15) to this formula, it is appreciated that e=0.

Therefore, in this active vibratory noise reduction system 10, even when the true values of the transfer characteristics estimated value Ĥ and the canceling sound transfer characteristics estimated value Ĉ are unknown, it can be guaranteed that if the second virtual error signal e'1 and the first virtual error signal e'2 converge to 0, the ratio between the transfer characteristics estimated value Ĥ and the canceling sound transfer characteristics estimated value Ĉ converges to a constant value, and the adaptive notch filter coefficient W of the third adaptive notch filter 70 that provides the filter coefficient to the control signal generation unit 25 serving as the control filter also converges to −H/C, which is the optimal value, and the sound pressure (error signal e) at the error microphone 11 is minimized. This means that the active vibratory noise reduction system 10 operates according to the principle that does not need pre-identification of the transfer characteristics (acoustic characteristics C) for the canceling sound from the loudspeaker 12 to the error microphone 11, and can execute noise canceling even if the acoustic characteristics C for the canceling sound change during the control.

Next, advantageous effects of the active vibratory noise reduction system 10 according to this embodiment will be described. FIG. 14 is a graph showing a change in the acoustic characteristics C assumed to occur in the active vibratory noise reduction system 10 shown in FIG. 10. As shown in FIG. 14, in the frequency band (100 Hz to 150 Hz)

corresponding to the engine rotational speeds from 3000 to 4500 RPM, the acoustic characteristics C change from the initial characteristics shown by the solid line to the current characteristics shown by the broken line, and it is assumed that a difference occurs between the canceling sound transfer characteristics estimated value Cˆ, which is the control parameter, and the actual acoustic characteristics C.

Under such a condition, when the active vibratory noise controller 13 according to the embodiment executes the noise reduction control, the sound pressure level of the engine muffling sound is reduced as shown in FIG. 15. FIG. 15 shows the sound pressure level when the control is off, when the stability improvement control according to a method that introduces a stabilization coefficient $\alpha$ is executed as the conventional example, and when the control of the first embodiment of the present invention is executed. As shown in FIG. 15, in the engine rotational speed region from 3000 to 4500 RPM where the actual acoustic characteristics C change, the control performance is considerably deteriorated in the conventional example resulting in an increase of sound level of about 15 dB near 3800 RPM. In contrast, in the present invention, during the control, it is possible to follow the change in the actual acoustic characteristics C, so that even when the actual acoustic characteristics C changes considerably, significant performance deterioration does not occur, and noise canceling of about 10 dB is achieved. In the regions where the acoustic characteristics C do not change, the present invention and the conventional example demonstrate similar performance. With regard to the initial convergence, the present invention is slower than the conventional example but the convergence time is very short, and once the convergence is achieved, noise canceling effect can be maintained thereafter and thus practically there is no problem.

As described above, in the active vibratory noise controller 13, the standard signal generation unit 21 estimates the frequency f of the vibratory noise d emitted from the engine/drive system, which is the vibratory noise source, based on the engine 2/drive system signal X which is the operation-related information of the engine 2/drive system, and accordingly generates the standard signals x (xc, xs) synchronous with the vibratory noise d. Also, the virtual error signal generation unit 80 generates the virtual error signal e' by using the error signal e and the vibratory noise estimation signal dˆ reaching the error microphone 11. Further, the vibratory noise estimation signal generation unit 28 sequentially updates the filter coefficients according to the adaptive algorithm using the virtual error signal e'. Therefore, even though the microphone or the vibration sensor for detecting the standard signals x is not provided and the transfer characteristics H of the vibratory noise d transferred from the vibratory noise source are not accurately identified, and even when a change occurs in the transfer characteristics H of the vibratory noise d, the active vibratory noise controller 13 can reduce the noise by the canceling vibratory noise y. Also, since the microphone and the vibration sensor become unnecessary, the configuration of the active vibratory noise controller 13 becomes simple, and further, noise does not enter the standard signals x (xc, xs) so that excellent noise canceling performance can be realized.

Furthermore, in the present embodiment, the vibratory noise estimation signal generation unit 28 is constituted of SAN filters, not FIR filters, and sequentially updates the filter coefficients by using the adaptive algorithm. Therefore, even for the vibratory noise d whose characteristics always change, the noise canceling performance can be ensured, and further, the amount of calculation therefor is small and an expensive processor with high processing performance is not required, whereby the active vibratory noise reduction system 10 having excellent noise canceling performance can be configured at low cost.

Further, in the active vibratory noise controller 13, the standard signal correction unit 26 corrects the standard signals x (xc, xs) with the adaptive notch filter coefficient W indicating the circuit characteristics of the control signal generation unit 25 to generate the control signal u0, and the first adaptive notch correction filter unit 60 corrects the control signal u0 with the canceling sound transfer characteristics estimated value Cˆ to generate the first estimated value yˆ1 of the canceling vibratory noise y at the error microphone 11. Also, the reference signal generation unit 27 corrects the standard signals x (xc, xs) with the canceling sound transfer characteristics estimated value Cˆ to generate the reference signals r (r0, r1), and the third adaptive notch filter 70, which has the adaptive notch filter coefficient W (W0, W1) that is provided to the control signal generation unit 25, corrects the reference signals r with the adaptive notch filter coefficient W to generate the second estimated value yˆ2 of the canceling vibratory noise y at the error microphone 11. Further, the virtual error signal generation unit 80 generates the virtual error signals e' by using the first estimated value yˆ1 and the second estimated value yˆ2 of the canceling vibratory noise y, and the first adaptive notch correction filter unit 60 and the third adaptive notch filter 70 sequentially update the corresponding filter coefficients according to the adaptive algorithm using the virtual error signals e'.

Specifically, in the virtual error signal generation unit 80, the second virtual error signal generation unit 81 generates the second virtual error signal e'1 based on the error signal e, the vibratory noise estimation signal dˆ, and the first estimated value yˆ1 of the canceling vibratory noise y, while the first virtual error signal generation unit 82 generates the first virtual error signal e'2 based on the second virtual error signal e'1 and the second estimated value yˆ2 of the canceling vibratory noise y. Then, the vibratory noise estimation signal generation unit 28 updates the filter coefficients based on the standard signals x (xc, xs) and the second virtual error signal e'1, the first adaptive notch correction filter unit 60 updates the filter coefficients based on the control signal u0 and the second virtual error signal e'1, and the third adaptive notch filter 70 updates the filter coefficients based on the reference signal r (r0, r1) and the first virtual error signal e'2.

Therefore, even if a significant change occurs in the transfer characteristics (acoustic characteristics C) for the canceling sound from the loudspeaker 12 to the error microphone 11 during the control, the three adaptive notch filters (28, 60, 70) sequentially update the filter coefficients by using the adaptive algorithm that uses the virtual error signals e', so that excellent noise canceling performance is achieved. Namely, due to the active vibratory noise controller 13 executing the noise reduction control according to the above-described control method in which the coefficients of the SAN filters are adaptively updated based on the virtual error signals e', an active vibratory noise reduction system 10 which does not require pre-identification of the acoustic characteristics C but, even when a significant change occurs in the acoustic characteristics C during the control, can follow the change in the acoustic characteristics C to demonstrate excellent noise canceling performance can be realized. In addition, since the active vibratory noise controller 13 uses adaptive notch filters consisting of SAN filters, not FIR filters, the amount of calculation is small and a high performance processor is unnecessary, whereby the active vibratory noise reduction system 10 can be realized at low cost.

Also, in the present embodiment, even if a significant change occurs in the acoustic characteristics C due to adjustment of the position or angle of the seats, noise reduction control can be executed without deterioration of the noise canceling performance, whereby it is possible to place the error microphone 11 on the headrest near the ears of the vehicle occupant or the like to improve the noise canceling effect near the ears of the vehicle occupant considerably.

Since the noise source is a rotating body included in the engine 2 or the drive system which is the drive source of the vehicle 1, the frequency f of the vibratory noise d has a narrow band, and the active vibratory noise reduction system 10 can reduce the vibratory noise d without fail.

Second Embodiment

Next, with reference to FIGS. 16 to 18, a second embodiment of the present invention will be described. Note that the elements same as or similar to those of the first embodiment will be denoted by the same reference signs, and redundant description will be omitted.

Figure 16:
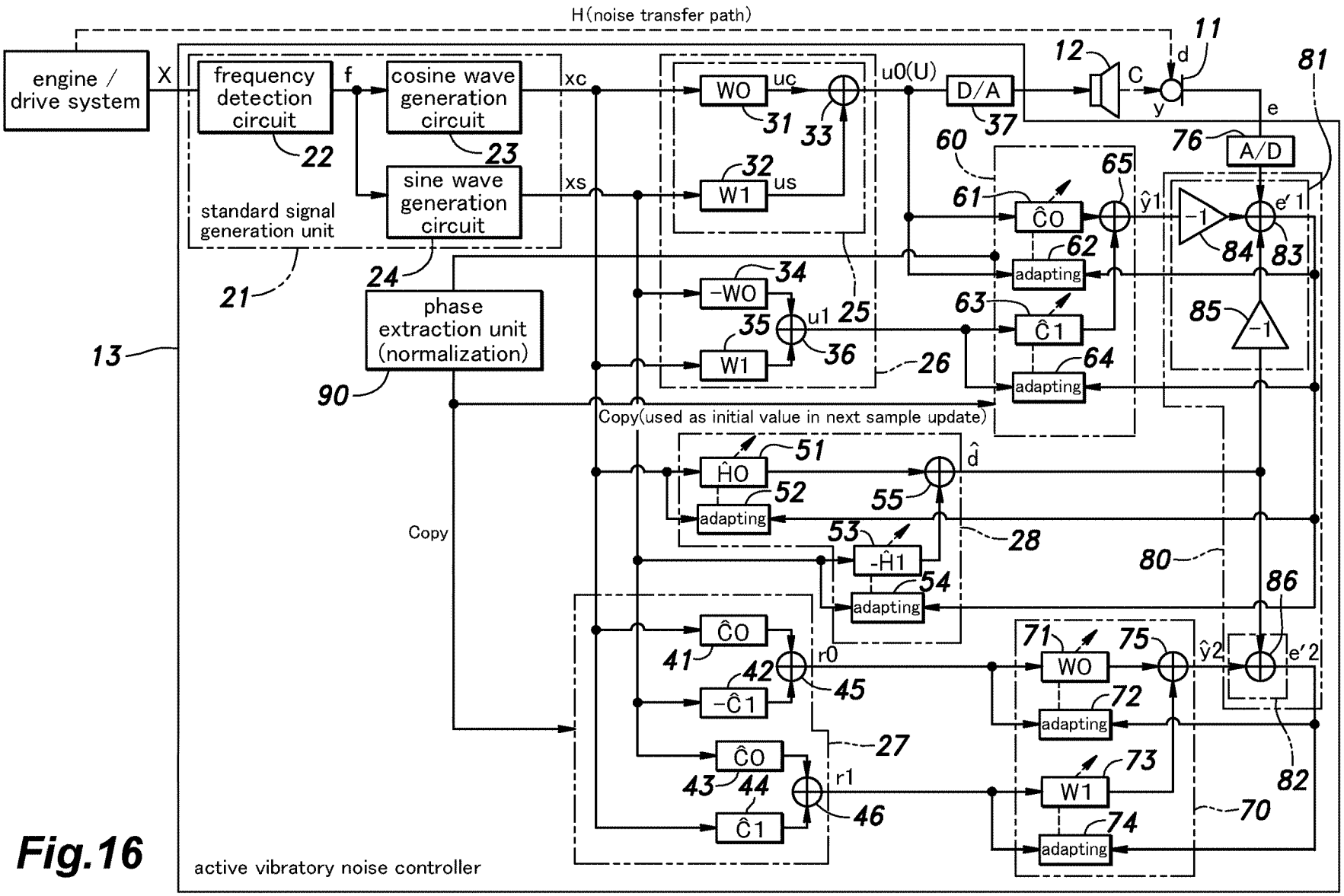
FIG. 16 is a functional block diagram of the active vibratory noise reduction system according to the second embodiment.
Figure 17:
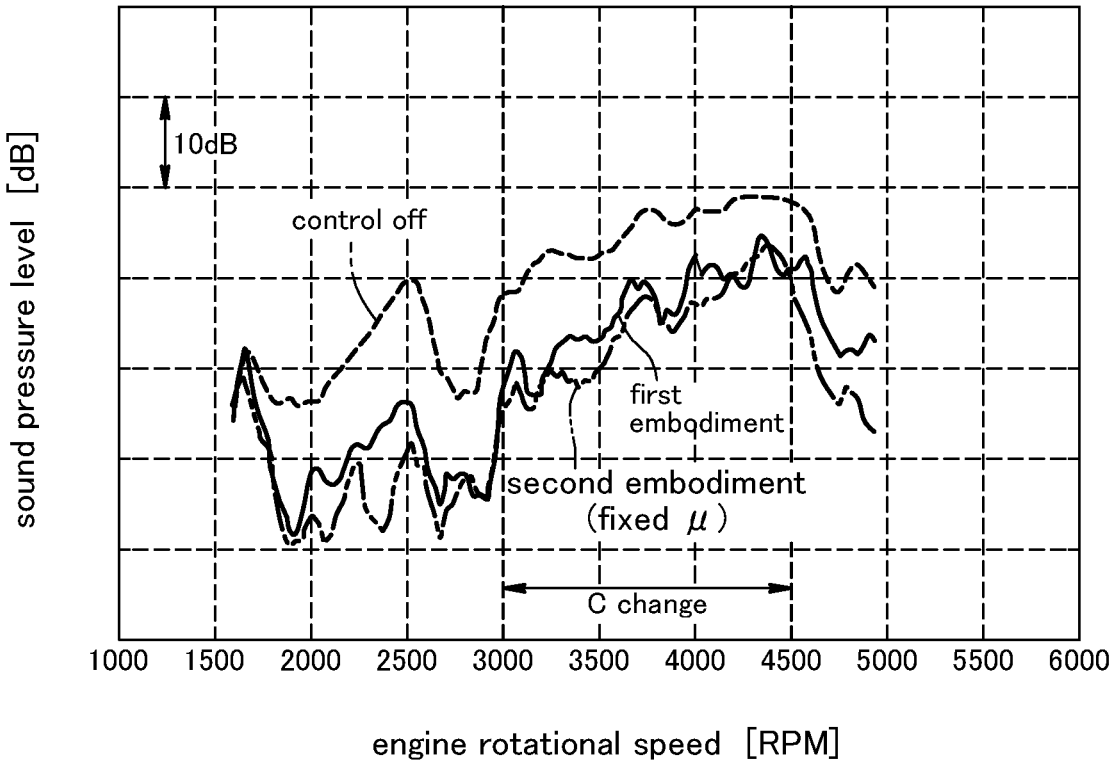
FIG. 17 is a graph showing the sound pressure level of the engine muffling sound in the active vibratory noise reduction system according to the second embodiment when the step size parameter is fixed in comparison with when the control is off and with the first embodiment.

FIG. 16 is a functional block diagram of an active vibratory noise reduction system 10 according to the second embodiment. As shown in FIG. 16, the active vibratory noise reduction system 10 of this embodiment differs from the first embodiment in that the active vibratory noise reduction system 10 of this embodiment additionally includes a phase extraction unit 90. In the following, description will be made concretely.

In the control method performed by the active vibratory noise controller 13 of the first embodiment, the first adaptive notch correction filter unit 60 corresponds to the estimated value (canceling sound transfer characteristics estimated value Ĉ) of the transfer characteristics (acoustic characteristics C) for the canceling sound from the loudspeaker 12 to the error microphone 11, and therefore, the magnitude of the filter coefficients thereof changes depending on the frequency f. If the canceling sound transfer characteristics estimated value Ĉ is small, the first and second corrected reference signals r0, r1, which are used in the update of the third adaptive notch filter 70 that provides the filter coefficients to the control signal generation unit 25, become small, and the convergence of the third adaptive notch filter 70 becomes slow. Further, since the output of the standard signal correction unit 26 including the control signal generation unit 25 having the adaptive notch filter coefficient W is also used in the update of the first adaptive notch correction filter unit 60, the convergence of the first adaptive notch correction filter unit 60 itself becomes slow. On the other hand, in the frequency band where the canceling sound transfer characteristics estimated value Ĉ is large, the convergence of the third adaptive notch filter 70 and the first adaptive notch correction filter unit 60 is fast but the amount of update for each update is large, and therefore, the control tends to be unstable.

Thus, to improve the convergence performance of the control method of the first embodiment, the active vibratory noise controller 13 of the present embodiment additionally includes the phase extraction unit 90 to perform the update of the filter coefficients using the phase information of the canceling sound transfer characteristics estimated value Ĉ, with out depending on the magnitude of the canceling sound transfer characteristics estimated value Ĉ.

As shown in the below formulas, in addition to that the vibratory noise estimation signal generation unit 28, the first adaptive notch correction filter unit 60, and the third adaptive notch filter 70 update the filter coefficients (Ĥ, Ĉ, W) according to the same formulas as in the first embodiment, the phase extraction unit 90 normalizes the canceling sound transfer characteristics estimated value Ĉ. Namely, by multiplying the real part Ĉ 0 and the imaginary part Ĉ1 of the canceling sound transfer characteristics estimated value Ĉ by the multiplicative inverse of the square root of sum of squares of the real part Ĉ 0 and the imaginary part Ĉ1, the phase extraction unit 90 calculates first and second normalized filter coefficients, respectively.

$$\hat{H}0_{n+1} = \hat{H}0_n - \mu_H \times e1_n \times rc_n, \quad \hat{H}1_{n+1} = \hat{H}1_n - \mu_H \times e1_n \times rs_n$$

$$\hat{C}0_{n+1} = \hat{C}0_n - \mu_C \times e1_n \times ur_n, \quad \hat{C}1_{n+1} = \hat{C}1_n - \mu_C \times e1_n \times ui_n$$

$$|\hat{C}|_{n+1} = \sqrt{\hat{C}0_{n+1}^2 + \hat{C}1_{n+1}^2}, \qquad \hat{C}0_{n+1} = \hat{C}0_{n+1} / |\hat{C}|_{n+1}.$$

$$\hat{C}1_{n+1} = \hat{C}1_{n+1} / |\hat{C}|_{n+1}$$

$$W0_{n+1} = W0_n - \mu_W \times e2_n \times cr_n, \; W1_{n+1} = W1_n - \mu_W \times e2_n \times ci_n$$

Here, "||" represents the amplitude of the complex number. Also, to reduce the amount of calculation, instead of the amplitude of the canceling sound transfer characteristics estimated value Ĉ, the larger one of the absolute values of the real part Ĉ0 and the imaginary part Ĉ1 of the canceling sound transfer characteristics estimated value Ĉ may be used.

$$|\hat{C}|_{n+1} \approx \max(|\hat{C}0_{n+1}|, |\hat{C}1_{n+1}|)$$

The reference signal generation unit 27 corrects the standard signals x (xc, xs) by using the canceling sound transfer characteristics estimated value Ĉ normalized by the phase extraction unit 90 using the above formulas, to generate the reference signals r (r0, r1). Then, by using the reference signals r (r0, r1), the third adaptive notch filter 70 generates the second estimated value ŷ2 of the canceling vibratory noise y. Further, the first adaptive notch correction filter unit 60 uses the canceling sound transfer characteristics estimated value Ĉ normalized by the phase extraction unit 90 when updating the canceling sound transfer characteristics estimated value Ĉ for the next sampling.

With the active vibratory noise controller 13 executing such control, the active vibratory noise reduction system 10 of the second embodiment demonstrates high noise canceling performance compared to the first embodiment. Specifically, due to the control in which the first adaptive notch correction filter unit 60 updates the filter coefficient by using the phase information of the first adaptive notch correction filter unit 60 corresponding to the estimated value of the transfer characteristics (acoustic characteristics C) for the canceling sound from the loudspeaker 12 to the error microphone 11, the convergence performance improves compared to the control method of the first embodiment. Details of the noise canceling performance will be described later.

Each adaptive notch filter (28, 60, 70) starts the adaptive update of the filter coefficient (Ĥ, Ĉ, W) thereof from an initial value (small value such as 0) set beforehand, and therefore, in order to achieve fast convergence from the initial value to the optimal value, it is necessary to make the amount of update for each update large. In this point of view, the step size parameter μ should be set to a large value. However, when the step size parameter μ is set to a large value, the adaptation process tends to be unstable. Thus, the convergence speed and the stability are in a tradeoff relationship.

Therefore, to improve the initial convergence speed from the control method of the first embodiment, it is preferred that each adaptive notch filter (28, 60, 70) changes the step size parameter μ depending on the magnitude of the filter coefficient. Each adaptive notch filter (28, 60, 70) updates the filter coefficient (Ĥ, Ĉ, W) according to the formulas similar to those of the first embodiment, but as shown in the below formulas, a calculation of multiplying the step size parameter μ of the respective update formula by the multiplicative inverse of the filter amplitude is added.

$$\mu_{HNn} = \frac{\mu_H}{|\hat{H}|_n},\ \mu_{CNn} = \frac{\mu_C}{|\hat{C}|_n},\ \mu_{WNn} = \frac{\mu_W}{|W|_n}$$

$$\hat{H}0_{n+1} = \hat{H}0_n - \mu_{HNn} \times e1_n \times rc_n,$$

$$\hat{H}1_{n+1} = \hat{H}1_n - \mu_{HNn} \times e1_n \times rs_n$$

$$\hat{C}0_{n+1} = \hat{C}0_n - \mu_{CNn} \times e1_n \times ur_n,$$

$$\hat{C}1_{n+1} = \hat{C}1_n - \mu_{CNn} \times e1_n \times ui_n$$

$$W0_{n+1} = W0_n - \mu_{WNn} \times e2_n \times cr_n,$$

$$W1_{n+1} = W1_n - \mu_{WNn} \times e2_n \times ci_n$$

$$|\hat{H}|_{n+1} = \sqrt{\hat{H}0_{n+1}^2 + \hat{H}1_{n+1}^2},$$

$$|\hat{C}|_{n+1} = \sqrt{\hat{C}0_{n+1}^2 + \hat{C}1_{n+1}^2},$$

$$|W|_{n+1} = \sqrt{W0_{n+1}^2 + W1_{n+1}^2}$$

By multiplying the step size parameter μ by the multiplicative inverse of the filter amplitude, in the early stage of the adaptation process, the step size parameter μ increases and the convergence speed becomes fast. As the filter coefficient (Ĥ, Ĉ, W) of each adaptive notch filter (28, 60, 70) converges, the step size parameter μ also becomes small and converses to a constant value. Therefore, the initial convergence of the adaptation process improves without compromising stability.

Also, to reduce the amount of calculation, the adaptive notch filters (28, 60, 70) may use, instead of the filter amplitude, the larger one of the absolute values of the first adaptive notch filter coefficient W0 (real part) and the second adaptive notch filter coefficient W1 (imaginary part) of the adaptive notch filter coefficient W, the larger one of the absolute values of the real part Ĥ0 and the imaginary part H1 of the transfer characteristics estimated value Ĥ, and the larger one of the absolute values of the real part Ĉ0 and the imaginary part Ĉ1 of the canceling sound transfer characteristics estimated value Ĉ absolute value, respectively, as shown in the below formulas.

$$|\hat{H}|_{n+1} \approx \max(|\hat{H}0_{n+1}|, |\hat{H}1_{n+1}1|),\ |\hat{C}|_{n+1} \approx \max(|\hat{C}0_{n+1}, |\hat{C}1_{n+1}|),$$

$$|W1|_{n+1} \approx \max(|W0_{n+1}|, |W1_{n+1}|)$$

Further, to improve the initial convergence speed and at the same time ensure minimum stability, each adaptive notch filter (28, 60, 70) may limit the maximum value of the step size parameter p. Taking the calculation of the step size parameter H for the update of the vibratory noise estimation signal generation unit 28 as an example, this can be represented by the below statements.

$$\mu_{HNn} = \frac{\mu_H}{|\hat{H}|_n},\ \text{If } \mu_{HNn} > \mu_{Hmax},\ \text{Then } \mu_{HNn} = \mu_{Hmax}$$

Similarly, the first adaptive notch correction filter unit 60 may limit the maximum value of the step size parameter μC for the update, and the third adaptive notch filter 70 may limit the maximum value of the step size parameter μW for the update in a similar manner as indicated by the above statements.

With the active vibratory noise controller 13 executing the control with the step size parameter being variable as described above, the active vibratory noise reduction system 10 of the second embodiment demonstrates high noise canceling performance compared to the first embodiment or when the step size parameter μ is fixed.

Next, advantageous effects of the active vibratory noise controller 13 according to this embodiment will be described. Similarly to the first embodiment, it is assumed that the acoustic characteristics C change as shown in FIG. 14. FIG. 17 is a graph showing the sound pressure level of the engine muffling sound in such a case. FIG. 17 shows the sound pressure level when the control is off, when the control of the first embodiment is executed, and when the control of the second embodiment (the step size parameter μ is fixed). As shown in FIG. 17, in the engine rotational speed region from 3000 to 4500 RPM where the acoustic characteristics C change, the active vibratory noise reduction system 10 of the second embodiment can follow the change in the acoustic characteristics C similarly to the first embodiment, achieving noise canceling effect of over 10 dB.

Further, in the active vibratory noise reduction system 10 of the second embodiment, the convergence performance is improved over the entire frequency band compared to the first embodiment. Particularly, it can be seen that on a low rotation speed side (low frequency side), the noise canceling performance is improved by over 5 dB in the active vibratory noise reduction system 10 of the second embodiment compared to the first embodiment. From the foregoing, the effectiveness of the active vibratory noise reduction system 10 of the second embodiment can be confirmed.

Figure 18:
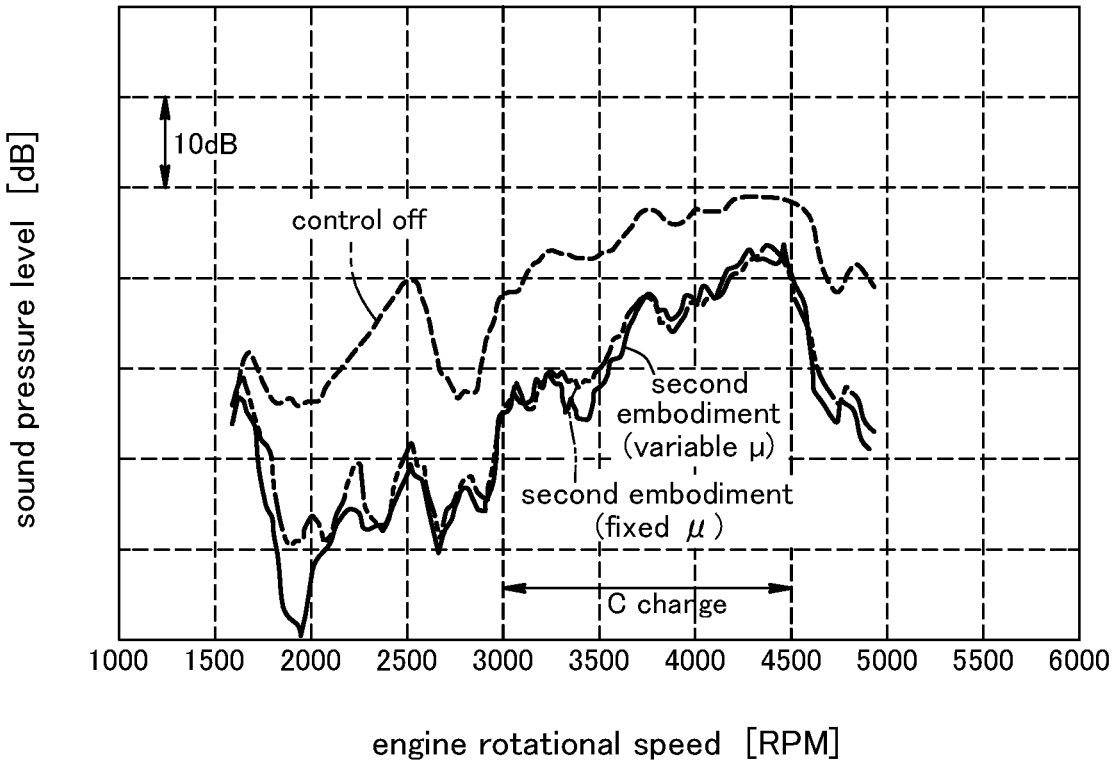
FIG. 18 is a graph showing the sound pressure level of the engine muffling sound in the active vibratory noise reduction system according to the second embodiment when the step size parameter is variable in comparison with when the control is off and when the step size parameter is fixed.

FIG. 18 is a graph showing the sound pressure level of the engine muffling sound in the case where the active vibratory noise controller 13 makes the step size parameter μ variable. FIG. 18 shows the sound pressure level when the control is off, when the control according to the second embodiment is executed with the step size parameter μ being fixed, and when the control according to the second embodiment is executed with the step size parameter μ being variable. As shown in FIG. 18, in the engine rotational speed region from 3000 to 4500 RPM where the acoustic characteristics C change, the active vibratory noise reduction system 10 of the second embodiment executing the control with the variable step size parameter μ can follow the change in the acoustic characteristics C and achieves noise canceling effect of over 10 dB.

Also, the active vibratory noise reduction system 10 of the second embodiment executing the control with the variable step size parameter μ improves the convergence performance compared to when the step size parameter μ is fixed. Particularly, in the region up to 2000 RPM in the early stage of the adaptation process, the noise canceling performance is improved by about 10 dB compared to when the step size parameter g is fixed. From the foregoing, it can be confirmed that by normalizing the step size parameter μ for the adaptive update, the initial convergence speed of the adaptive update improves compared to the control method of the first embodiment.

Also, in the present embodiment, the active vibratory noise controller 13 further includes the phase extraction unit 90 configured to extract the phase of the filter coefficient corresponding to the canceling sound transfer characteristics estimated value Cˆ, and the reference signal generation unit 27 corrects the standard signals x (xc, xs) with the extracted phase, not with the canceling sound transfer characteristics estimated value Cˆ. Therefore, an influence of the amplitude characteristics of the canceling sound transfer characteristics estimated value Cˆ on the amount of filter coefficient update is reduced, whereby the convergence performance of the adaptive update improves compared to the control method of the first embodiment. In other words, the canceling sound transfer characteristics estimated value Cˆ has an amplitude component and a phase component, and if the amount of change of the amplitude component becomes large, the amount of change of the canceling sound transfer characteristics estimated value Cˆ also becomes large. Also, there is a particular frequency band where the amplitude component of the canceling sound transfer characteristics estimated value Cˆ changes considerable due to change in the frequency f, and when in this frequency band, the canceling sound transfer characteristics estimated value Cˆ changes significantly. Therefore, when in this frequency band, the amount of update of the filter coefficient becomes large, and the convergence performance of the adaptive update may be lowered. In the present embodiment, a phase (component) is extracted from the canceling sound transfer characteristics estimated value Cˆ, and the standard signal x is corrected with this phase, whereby the amount of update of the filter coefficient is suppressed and the convergence performance of the adaptive update improves.

Further, the vibratory noise estimation signal generation unit 28, the first adaptive notch correction filter unit 60, and the third adaptive notch filter 70 normalize the step size parameter μ for adjusting the amount of update of the filter coefficient for each sampling by multiplying the step size parameter μ by the multiplicative inverse of the adaptive notch filter amplitude, and update the corresponding filter coefficient (Hˆ, Cˆ, W) by using the normalized step size parameter μ. Therefore, the amount of filter coefficient update for each sampling is automatically adjusted, whereby the initial convergence performance of the adaptive update improves compared to the control method of the first embodiment, without compromising the control stability.

Concrete embodiments of the present have been described in the foregoing, but the present invention is not limited to the above embodiments and may be modified or altered in various ways. For example, in the above-described embodiments, the active vibratory noise reduction system 10 had a configuration shown in FIG. 10 as an example, but the active vibratory noise reduction system 10 may have a configuration shown in FIG. 11 or FIG. 12. In these cases, the above description is applicable by replacing the term "canceling sound" with "canceling vibration." Besides, the concrete structure, arrangement, number, etc. of each member or part as well as concrete formulas and procedures may be appropriately changed within the scope of the present invention. The above-described embodiments may be combined as appropriate. Also, not all of the components shown in the foregoing embodiments are necessarily indispensable and they may be selectively adopted as appropriate.

The invention claimed is:

1. An active vibratory noise reduction system comprising:

a standard signal generation section configured to generate, as standard signals, a standard sine wave signal and a standard cosine wave signal having a frequency in accordance with a frequency of vibratory noise generated from a vibratory noise source;

a first adaptive notch control filter configured to output a first control signal based on the standard cosine wave signal;

a second adaptive notch control filter configured to output a second control signal based on the standard sine wave signal;

a vibratory noise canceler configured to output canceling vibratory noise based on a first addition signal obtained by adding the first control signal and the second control signal;

an error signal detector configured to output an error signal based on a difference between the vibratory noise generated from the vibratory noise source and the canceling vibratory noise output from the vibratory noise canceler;

a correction section configured to generate first and second reference signals by correcting the standard cosine wave signal and the standard sine wave signal with a first correction filter and a second correction filter corresponding to signal transfer characteristics from the vibratory noise canceler to the error signal detector for the frequency of the standard signals and to output the first and second reference signals;

a first estimation signal generation section configured to correct the standard cosine wave signal and the standard sine wave signal with a third correction filter and a fourth correction filter to obtain first and second vibratory noise estimation signals, respectively, and to generate a vibratory noise estimation signal by adding the first vibratory noise estimation signal and the second vibratory noise estimation signal;

a second estimation signal generation section configured to generate a first canceling vibratory noise estimation signal by adding a first corrected control signal obtained by correcting the standard cosine wave signal with the first correction filter and the first adaptive notch control filter, a second corrected control signal obtained by correcting the standard sine wave signal with the second correction filter and the first adaptive notch control filter, a third corrected control signal obtained by correcting the standard sine wave signal with the first correction filter and the second adaptive notch control filter, and a fourth corrected control signal obtained by correcting the standard cosine wave signal with the second correction filter and the second adaptive notch control filter;

a first virtual error signal generation section configured to generate a first virtual error signal from the vibratory noise estimation signal and the first canceling vibratory noise estimation signal; and a first filter coefficient updating section configured to sequentially update filter coefficients of the first and second adaptive notch control filters based on the first and second reference signals and the first virtual error signal such that the first virtual error signal is minimized.

2. The active vibratory noise reduction system according to claim 1, wherein the first adaptive notch control filter is configured to output a third control signal based on the standard sine wave signal, the second adaptive notch control filter is configured to output a fourth control signal based on the standard cosine wave signal, the first correction filter is configured by a first adaptive notch correction filter, and the second correction filter is configured by a second adaptive notch correction filter, the active vibratory noise reduction system further comprising:

a third estimation signal generation section configured to generate a second canceling vibratory noise estimation signal by adding a fifth corrected control signal, which is obtained by correcting the first addition signal with the first adaptive notch correction filter, and a sixth corrected control signal, which is obtained by correcting, with the second adaptive notch correction filter, a second addition signal obtained by adding the third control signal and the fourth control signal;

a second virtual error signal generation section configured to generate a second virtual error signal from the error signal, the vibratory noise estimation signal, and the second canceling vibratory noise estimation signal; and a second filter coefficient updating section configured to sequentially update filter coefficients of the first and second adaptive notch correction filters based on the first control signal, the second control signal, the third control signal, the fourth control signal, and the second virtual error signal such that the second virtual error signal is minimized.

3. The active vibratory noise reduction system according to claim 2, wherein the third correction filter is configured by a third adaptive notch correction filter, and the fourth correction filter is configured by a fourth adaptive notch correction filter, the active vibratory noise reduction system further comprising a third filter coefficient updating section configured to sequentially update filter coefficients of the third and fourth adaptive notch correction filters based on the standard sine wave signal, the standard cosine wave signal, and the second virtual error signal such that the second virtual error signal is minimized.

4. The active vibratory noise reduction system according to claim 2, further comprising a normalization section configured to calculate first and second normalized filter coefficients by multiplying the filter coefficients of the first and second adaptive notch correction filters by a multiplicative inverse of a square root of sum of squares of the filter coefficients of the first and second adaptive notch correction filters, respectively, wherein the correction section is configured to generate the first and second reference signals by correcting the standard cosine wave signal and the standard sine wave signal with the first adaptive notch correction filter having the first normalized filter coefficient and the second adaptive notch correction filter having the second normalized filter coefficient.

5. The active vibratory noise reduction system according to claim 2, further comprising a normalization section configured to calculate third and fourth normalized filter coefficients by multiplying the filter coefficients of the first and second adaptive notch correction filters by a multiplicative inverse of a larger one of absolute values of the filter coefficients of the first and second adaptive notch correction filters, respectively, wherein the correction section is configured to generate the first and second reference signals by correcting the standard cosine wave signal and the standard sine wave signal with the first adaptive notch correction filter having the third normalized filter coefficient and the second adaptive notch correction filter having the fourth normalized filter coefficient.

6. The active vibratory noise reduction system according to claim 3, wherein each of the first, second, and third filter coefficient updating sections is configured to determine a step size parameter for controlling an amount of update of the filter coefficients of the adaptive notch filters to be updated thereby based on a square root of sum of squares of the filter coefficients immediately before the update.

7. The active vibratory noise reduction system according to claim 3, wherein each of the first, second, and third filter coefficient updating section is configured to determine a step size parameter for controlling an amount of update of the filter coefficients of the adaptive notch filters to be updated thereby based on a larger one of absolute values of the filter coefficients immediately before the update.

* * * * *